US006685342B2

(12) United States Patent
Terada

(10) Patent No.: US 6,685,342 B2
(45) Date of Patent: Feb. 3, 2004

(54) PRISM STRUCTURE FOR FLASH ILLUMINATION DEVICES

(75) Inventor: Hiroshi Terada, Mitaka (JP)

(73) Assignee: Olympus Optical Co., Ltd., Tokyo (JP)

( * ) Notice: Subject to any disclaimer, the term of this patent is extended or adjusted under 35 U.S.C. 154(b) by 47 days.

(21) Appl. No.: 09/999,006

(22) Filed: Oct. 31, 2001

(65) Prior Publication Data

US 2002/0080614 A1 Jun. 27, 2002

(30) Foreign Application Priority Data

Nov. 6, 2000 (JP) ..... 2000-338083

(51) Int. Cl.[7] ..... F21V 5/02

(52) U.S. Cl. ..... 362/327; 362/16; 362/332; 362/339; 359/833

(58) Field of Search ..... 302/16, 327, 332, 302/339, 3, 17, 317, 326, 333, 334, 340; 359/833, 831, 834; 313/113, 114, 116; 385/36

(56) References Cited

U.S. PATENT DOCUMENTS 2,356,654 A * 8/1944 Cullman ..... 362/327
3,484,597 A * 12/1969 Schmidt ..... 362/16
5,414,598 A * 5/1995 Anderson ..... 362/26
5,813,743 A * 9/1998 Naka ..... 362/16
6,022,117 A 2/2000 Tenmyo et al.
6,193,383 B1 * 2/2001 Onikiri et al. ..... 362/327
6,238,076 B1 * 5/2001 Pascale et al. ..... 362/26
6,467,931 B2 * 10/2002 Tenmyo ..... 362/16

FOREIGN PATENT DOCUMENTS

JP 4-138440 A 5/1992
JP 10-115853 A 5/1998

* cited by examiner

*Primary Examiner*—Alan Cariaso
*Assistant Examiner*—Ismael Negron
(74) *Attorney, Agent, or Firm*—Frishauf, Holtz, Goodman & Chick, P.C.

(57) ABSTRACT

A prism unit has transmitting/totally-reflecting surfaces which cross each other, formed using at least one prism. Light emanating from a light source falls on the prism unit. The light is transmitted or totally reflected from the surfaces according to an angle of incidence at which the light falls on the prism unit. Transmitted light is radiated forwards, while totally-reflected light is directed laterally. A reflecting member is located laterally in order to cover the prism unit, whereby light totally reflected laterally by the prism unit is reflected forwards. In order to constitute the transmitting/totally—reflecting surfaces, a first air layer and a second air layer are formed in the prism unit so to have a substantially uniform width and oppose each other with a plane, which contains a glowing member of the light source and extends forwards, between them.

13 Claims, 17 Drawing Sheets

PRISM STRUCTURE FOR FLASH ILLUMINATION DEVICES

This application claims the benefit of Japanese Application No. 2000-338033 filed in Japan on Nov. 6, 2000, the contents of which are incorporated herein by reference.

BACKGROUND OF THE INVENTION

1. Field of the Invention

The present invention relates to an illumination device, or more particularly, an illumination device for radiating illumination light (flashlight) to an object during photography performed by a camera.

2. Description of the Related Art

Conventionally, when a camera is used to perform photography, if the photography is performed at night, indoors, or with an object backlit, an illumination device is used to radiate illumination light (flashlight) to the object.

The illumination device is mounted in a part of a camera body so that illumination light (flashlight) can be radiated to an object while being interlocked with a photographic action of the camera. Photography is thus achieved.

FIG. 22 and FIG. 23 show sectional views of a conventional illumination device. An illustrated illumination device 10 has a cylindrical flash tube 12, for example, a xenon (Xe) flash tube placed inside the back 11*a* of a reflector 11 having a radial section. At this time, the flash tube 12 is placed so that the longitudinal direction thereof will be orthogonal to a center axis 13 of the reflector 11. All that restricts the direction of light emanating from a glowing member of the flash tube 12 is the reflector 11 including the back 11*a* thereof. Light emanating from the glowing member of the flash tube 12 is not reflected from the inner wall of the reflector 11 but radiated directly to the outside of the reflector 11. Besides, the light is reflected from the inner wall of the reflector 11 and radiated to the outside of the reflector 11. Besides, the light is reflected from inner wall of the reflector 11 and radiated to the outside of the reflector 11. Other part of the light (indicated with a mark x) leaks out through a gap between the reflector 11 and flash tube 12.

FIG. 22 shows numerous light rays emitted at different angles from a center point O in the glowing member of the flash tube 12. FIG. 23 shows numerous light rays emitted at different angles from a glowing point A that is off the center point O in the glowing member of the flash tube 12. Part of the light rays are emitted from the glowing points and radiated directly to outside through the interior of the reflector 11. Other part of the light rays are reflected from the inner surface of the reflector 11 and radiated to outside. Moreover, still other part of the light rays is directed from the glowing points to the back 11*a* of the reflector. The light rays directed from the glowing points to the back 11*a* of the reflector fall into three parts. That is to say, one part of the light rays is reflected from the inner surface of the back 11*a* of the reflector, propagated through the interior of the reflector 11, and emitted through an opening 11*b*. Other part of the light rays is reflected from the inner surface of the reflector 11 and then radiated through the opening 11*b*. Still other part of the light rays is radiated to outside through the gap between the reflector 11 and flash tube 12 on both sides without being reflected from the inner surface of the reflector 11 (this part of the light rays does not effectively work on an object).

Each angle written in FIG. 22 is an angle of radiation (an angle to the center axis of radiation 13) at which a light ray that passes through the reflector 11 is radiated to an object (upwards in the drawing), which is not shown, through the opening 11*b* that opens radially. An angle of radiation required to distribute light to a relatively narrow area and comparable to an angle of view offered by a photography lens employed shall be, for example, 16°. Light rays indicated with angles that are larger than 16° are radiated to an area outside a desired photographic range in which an object lies. The light rays do not work effectively on the object during photography. The conventional illumination device shown in FIG. 22 and FIG. 23 has numerous light rays radiated at angles of radiation that exceed an effective range from 0° to 16°, and thus suffers from poor radiation efficiency.

Accordingly, proposals have been made in efforts to improve the radiation efficiency or radiation characteristic of an illumination device.

For example, Japanese Unexamined Patent Application Publication No. 4-138440 describes the structure of an illumination device that radiates light, which diverges from a cylindrically long discharge tube, forwards. Specifically, prisms are placed in front of both the sides of the discharge tube so that light traveling in the longitudinal direction of the discharge tube will be converged forwards.

Moreover, Japanese Unexamined Patent Application Publication No. 10-115853 describes a structure having a plurality of prisms that acts like a light guide located in front of a glowing member, otherwise, one prism is slit in order to draw out the similar effect as that provided by a plurality of light guides.

On the other hand, an illumination device for cameras is required to have an angle of radiation comparable to an angle of view offered by a photography lens employed in a camera (a wide-angle lens, a standard lens, a telephoto lens, etc.).

However, in the structure described in the Japanese Unexamined Patent Application Publication No. 4-138440, only prisms are placed in front of both the sides of a discharge tube. As FIG. 1A in the above publication illustrates, light that is emitted from the glowing member of the discharge tube and radiated forwards without being passed through any prism travels rectilinearly but is neither refracted nor reflected in a space between the prisms placed on both the sides of the discharge tube. Therefore, a radiation range of the light is wide. If light must be distributed to a small area, the light cannot be converged efficiently. Moreover, the distance between the prisms placed on both the sides of the discharge tube must be set longer than an arc length of a discharge tube. When a large-energy flash tube characterized by an arc length larger than an arc length made by a discharge tube is used to distribute light to a small area, radiation efficiency is very poor.

Furthermore, the above publication discloses a type of flash tube having a reflecting member placed inside the prisms as illustrated in FIG. 3A of the above publication. This type of flash tube has a drawback that the reflecting surface of the reflecting member must be in a complex shape. Besides, even when light must be distributed to a narrow area, the light cannot be converged efficiently.

According to the Japanese Unexamined Patent Application Publication No. 10-115853, a light guide unit is included independently of a housing panel member of a camera body located in front of the light guide unit. This means that a housing panel member must be procured independently of a light guide member. Moreover, light is radiated by merely utilizing total reflection caused by light guides. Light is therefore radiated radially from the emitting surfaces of the light guides opposed to the incidence surfaces thereof. This poses a problem in that light is hard to be efficiently converged on a narrow area.

SUMMARY OF THE INVENTION

Accordingly, an object of the present invention is to provide an illumination device that is required to distribute light to a relatively narrow area and can allow light to efficiently converge on an object.

According to a first aspect of the present invention, there is provided an illumination device for radiating diverging light, which emanates from a light source, forwards. The illumination device consists mainly of a prism and a reflecting member.

The prism has an incidence surface and a transmitting/totally-reflecting surface. The incidence surface is opposed to the light source so that light emanating from the light source can fall on the incidence surface. The transmitting/totally-reflecting surface can transmit or totally reflect light, which has passed through the incidence surface, according to an angle of incidence. The transmitting/totally-reflecting surface radiates transmitted light forwards, and directs totally-reflected light laterally.

The reflecting member reflects light, which is totally reflected laterally from the transmitting/totally-reflecting surface, forwards.

According to the first aspect, light emanating from the light source falls on the prism. The light is transmitted or totally reflected from the transmitting/totally-reflecting surface of the prism according to an angle of incidence. The transmitted light is radiated forwards, while the totally-reflected light is directed laterally. The reflecting member reflects light, which is totally reflected laterally from the prism, forwards. The combination of the prism and reflecting member efficiently radiates light, which emanates from the light source, to a specific forward area.

According to a second aspect of the present invention, there is provided an illumination device consisting mainly of a flash tube and a prism.

The flash tube is cylindrically long and emits illumination light.

The prism is located in front of the flash tube and has a transmitting/totally-reflecting surface that transmits or totally reflects light, which diverges from the flash tube, according to an angle of incidence at which the light meets the surface. The transmitting/totally-reflecting surface is opposed substantially entirely to the longitudinal direction of the flash tube so that transmitted light will be radiated forwards and totally-reflected light will be directed laterally.

According to the second aspect, the prism having the transmitting/totally-reflecting surface opposed substantially entirely to the longitudinal direction of the flash tube is located in front of the cylindrically long flash tube. Light emanating from the flash tube falls on the prism and is transmitted or totally reflected from the transmitting/totally-reflecting surface of the prism according to an angle of incidence. Light transmitted from the prism is radiated forwards, while light totally-reflected therefrom is directed laterally. Light is thus oriented. Consequently, if the light totally-reflected from the prism and directed laterally is directed forwards using any other means, the light is efficiently converged on a specific forward area.

According to a third aspect of the present invention, there is provided an illumination device for radiating diverging light, which emanates from a cylindrically long flash tube, forwards. The illumination device consists mainly of a first prism and a second prism.

The first prism is located in front of the flash tube, and has a first transmitting/totally-reflecting surface opposed substantially entirely to the longitudinal direction of the flash tube. The first transmitting/totally-reflecting surface transmits light that diverges from the flash tube at an angle smaller than a predetermined angle relative to the center axis of radiation in the illumination device that lies in the longitudinal direction of the flash tube, and radiates the light forwards. Moreover, the first transmitting/totally-reflecting surface totally reflects light that diverges from the flash tube at an angle larger than the predetermined angle relative to the center axis of radiation in the illumination device, and directs the light laterally.

The second prism is located in front of the flash tube and has a second transmitting/totally-reflecting surface opposed substantially entirely to the longitudinal direction of the flash tube. The second transmitting/totally-reflecting surface transmits light that diverges from the flash tube at an angle smaller than the predetermined angle relative to the center axis of radiation in the illumination device that lies in the longitudinal direction of the flash tube, and radiates the light forwards. Moreover, the second transmitting/totally-reflecting surface totally reflects light that diverges from the flash tube at an angle larger than the predetermined angle relative to the center axis of radiation in the illumination device, and directs the light laterally.

According to a fourth aspect of the present invention, there is provided an illumination device for radiating diverging light, which emanates from a cylindrically long flash tube, forwards. The illumination device consists mainly of a prism unit and a reflecting member.

The prism unit is located in front of the flash tube and has an incidence surface, a transmitting/totally-reflecting surface, and an emitting surface. Light diverging from the flash tube falls on the incidence surface. The transmitting/totally-reflecting surface transmits or totally reflects light, which has passed through the incidence surface, according to an angle of incidence at which the light meets the surface. The transmitting/totally-reflecting surface is opposed substantially entirely to the longitudinal direction of the flash tube so that transmitted light will be radiated forwards and totally-reflected light will be directed laterally. The emitting surface finally radiates the light, which is transmitted or totally reflected from the transmitting/totally-reflecting surface, forwards.

The reflecting member reflects light, which is laterally reflected totally from the transmitting/totally-reflecting surface, forwards towards the emitting surface.

According to a fifth aspect of the present invention, there is provided an illumination device consisting mainly of a flash tube and a prism.

The flash tube is cylindrically long and emits illumination light.

The prism is located in front of the flash tube and has a transmitting/totally-reflecting surface. The transmitting/totally-reflecting surface transmits or totally reflects light, which diverges from the flash tube, according to an angle of incidence at which the light meets the surface. The transmitting/totally-reflecting surface is opposed substantially entirely to the longitudinal direction of the flash tube while being inclined by a predetermined slope relative to the longitudinal direction of the flash tube, so that transmitted light will be radiated forwards and totally-reflected light will be directed laterally.

According to a sixth aspect of the present invention, there is provided an illumination device for radiating diverging light, which emanates from a flash tube, forwards. The illumination device consists mainly of an optical prism and a pair of air layers.

The optical prism has a transmitting/totally-reflecting surface that transmits or totally reflect light, which diverges from the flash tube, according to an angle of incidence at which the light meets the surface. The transmitting/totally-reflecting surface is opposed substantially entirely to the flash tube in front of the flash tube, and used to converge and radiate light forwards.

The pair of air layers is formed in the optical prism in order to constitute the transmitting/totally-reflecting surface so that the air layers will have a substantially uniform width and face the flash tube.

According to the sixth aspect, the optical prism having the transmitting/totally-reflecting surface opposed substantially entirely to the flash tube is located in front of the flash tube. Using the transmitting/totally-reflecting surface, light diverging from the flash tube is converged and radiated forwards. The gaps, that is, the pair of air layers which has a substantially uniform width is formed in the optical prism, thus realizing the transmitting/totally-reflecting surface.

According to a seventh aspect of the present invention, there is provided an illumination device for radiating diverging light, which emanates from a cylindrically long flash tube, forwards. The illumination device consists mainly of an optical prism, a reflecting member, a housing panel, and a pair of air layers.

The optical prism is located in front of the flash tube, and has an incidence surface, a transmitting/totally-reflecting surface, and an emitting surface. Light diverging from the flash tube falls on the incidence surface. The transmitting/totally-reflecting surface transmits or totally reflects light, which has passed through the incidence surface, according to an angle of incidence at which the light meets the surface. The transmitting/totally-reflecting surface is opposed substantially entirely to the longitudinal direction of the flash tube, so that transmitted light will be radiated forwards and totally-reflected light will be directed laterally. The emitting surface finally radiates the light, which is transmitted or totally reflected from the transmitting/totally-reflecting surface, forwards.

The reflecting member is formed to cover at least part of the periphery of the optical prism, and reflects light, which passes the periphery of the optical prism, towards the emitting surface.

A housing panel is formed integratelly with the emitting surface of the optical prism and exposed as a housing member.

The pair of air layers is formed in the optical prism in order to constitute realize the transmitting/totally-reflecting surface so that the air layers will have a substantially uniform width and be opposed to the flash tube.

According to the seventh aspect, light diverging from the cylindrically long flash tube falls on the optical prism, and is transmitted or totally reflected from the transmitting/totally-reflecting surface according to an angle of incidence. Transmitted light is radiated forwards, and totally-reflected light is directed laterally. The reflecting member directs the light, which is totally reflected laterally from the prism, forwards. Consequently, the combination of the prism and reflecting member efficiently radiates light, which diverges from the flash tube, to a specific forward area. Moreover, the housing panel is formed integratelly with the emitting surface of the optical prism. The housing panel integrated with the optical prism is attached to the housing member of a camera body, whereby the optical prism encased in front of the flash tube in the reflecting member is mounted in the camera body. Thus, the illumination device can be readily positioned and fixed to the camera body.

According to an eighth aspect of the present invention, there is provided an illumination device for radiating diverging light, which emanates from a flash tube, forwards. The illumination device consists mainly of an optical prism and a housing panel.

The optical prism has a transmitting/totally-reflecting surface that transmits or totally reflects light, which diverges from the flash tube, according to an angle of incidence at which the light meets the surface. The transmitting/totally-reflecting surface is opposed substantially entirely to the face of the flash tube. Using the transmitting/totally-reflecting surface, light is converged and radiated forwards.

The housing panel is formed integratelly with the emitting surface of the optical prism and exposed as a housing member.

According to a ninth aspect of the present invention, there is provided an illumination device for radiating diverging light, which emanates from a cylindrically long flash tube, forwards. The illumination device consists mainly of an optical prism, a housing panel, and a reflecting member.

The optical prism is located in front of the flash tube and has an incidence surface, a transmitting/totally-reflecting surface, and an emitting surface. Light diverging from the flash tube falls on the incidence surface. The transmitting/totally-reflecting surface transmits or totally reflects light, which has passed through the incidence surface, according to an angle of incidence at which the light meets the surface. The transmitting/totally-reflecting surface is opposed substantially entirely to the longitudinal direction of the flash tube so that transmitted light will be radiated forwards and totally-reflected light will be directed laterally. The emitting surface finally radiates light, which is transmitted or totally reflected from the transmitting/totally-reflecting surface, forwards.

The housing panel is formed integratelly with the emitting surface of the optical prism and exposed as a housing member.

The reflecting member is formed to cover at least part of the periphery of the optical prism, and reflects light, which passes the periphery of the optical prism, towards the emitting surface.

According to a tenth aspect of the present invention, there is provided an illumination device for radiating diverging light, which emanates from a cylindrically long flash tube, forwards. The illumination device consists mainly of a first prism, a second prism, a reflecting member, a housing prism, and a prism unit forming means.

A first prism is located in front of the flash tube and has a first transmitting/totally-reflecting surface. The transmitting/totally-reflecting surface is opposed substantially entirely to the longitudinal direction of the flash tube, so that light diverging from the flash tube at an angle smaller than a predetermined angle relative to the center axis of radiation in the illumination device that lies in the longitudinal direction of the flash tube will be transmitted and radiated forwards, and light diverging from the flash tube at an angle larger than the predetermined angle relative to the center axis of radiation in the illumination device will be totally reflected and directed laterally.

A second prism is located in front of the flash tube and has a second transmitting/totally-reflecting surface. The transmitting/totally-reflecting surface is opposed substantially entirely to the longitudinal direction of the flash tube, so that light diverging from the flash tube at an angle smaller than the predetermined angle relative to the center axis of radiation in the illumination device that lies in the longitudinal direction of the flash tube will be transmitted and radiated forwards, and light diverging from the flash tube at an angle larger than the predetermined angle relative to the center axis of radiation in the illumination device will be totally reflected and directed laterally.

The reflecting member is formed to cover at least part of the periphery of the optical prism and reflects light that passes the periphery of the optical prism.

The housing prism has an incidence surface and an emitting surface. Light transmitted or totally reflected from the transmitting/totally-reflecting surface finally falls on the incidence surface. The emitting surface emits the light, which falls on the incidence surface, forwards. The emitting surface is exposed as a housing member.

The prism unit forming means is used to place the first transmitting/totally-reflecting surface of the first prism and the second transmitting/totally-reflecting surface of the second prism that are opposed to the incidence surface of the housing prism with a gap of a substantially uniform width between them.

DESCRIPTION OF THE PREFERRED EMBODIMENTS

Embodiments of the present invention will be described with reference to the drawings.

In the embodiments, a prism unit composed of a plurality of prisms is encased in a reflector. The prism unit has air layers of a narrow width formed like a cross so that light can be converged efficiently.

Before an illumination device in accordance with a first embodiment of the present invention is described in conjunction with FIG. 1 and FIG. 2, the basic principles of the present invention will be described with reference to FIG. 3 to FIG. 6.

Figure 1:
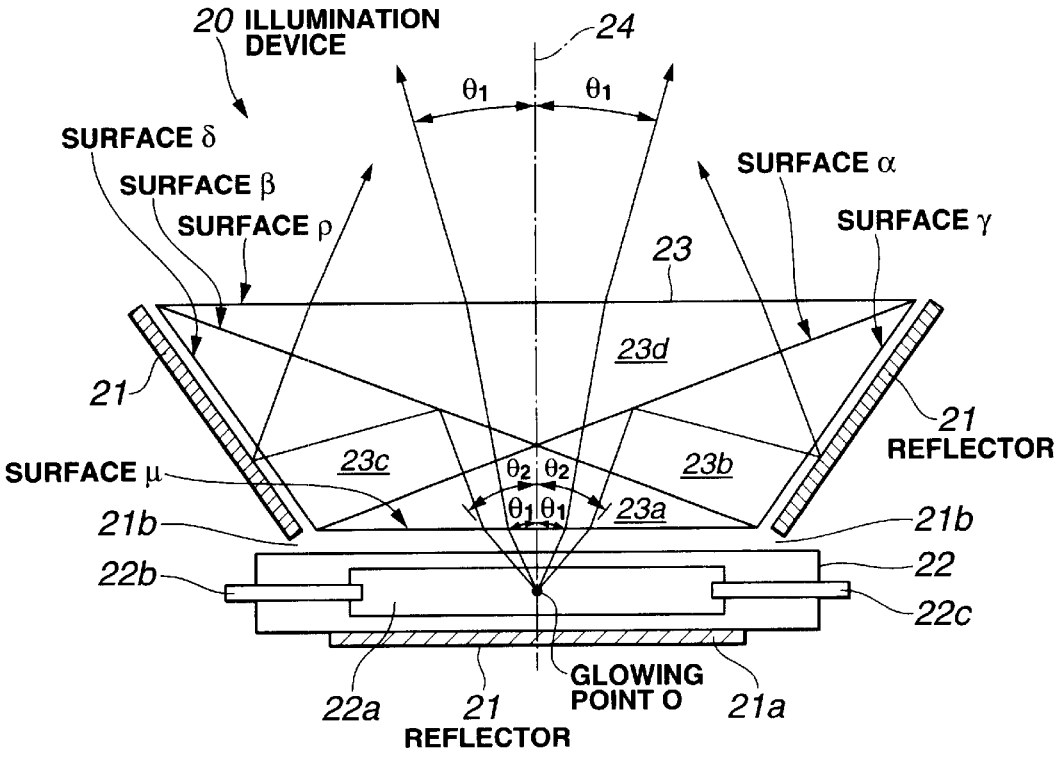
FIG. 1 is a sectional view showing an illumination device in accordance with a first embodiment of the present invention in which a glowing point coincides with the center of a flash tube.
Figure 2:
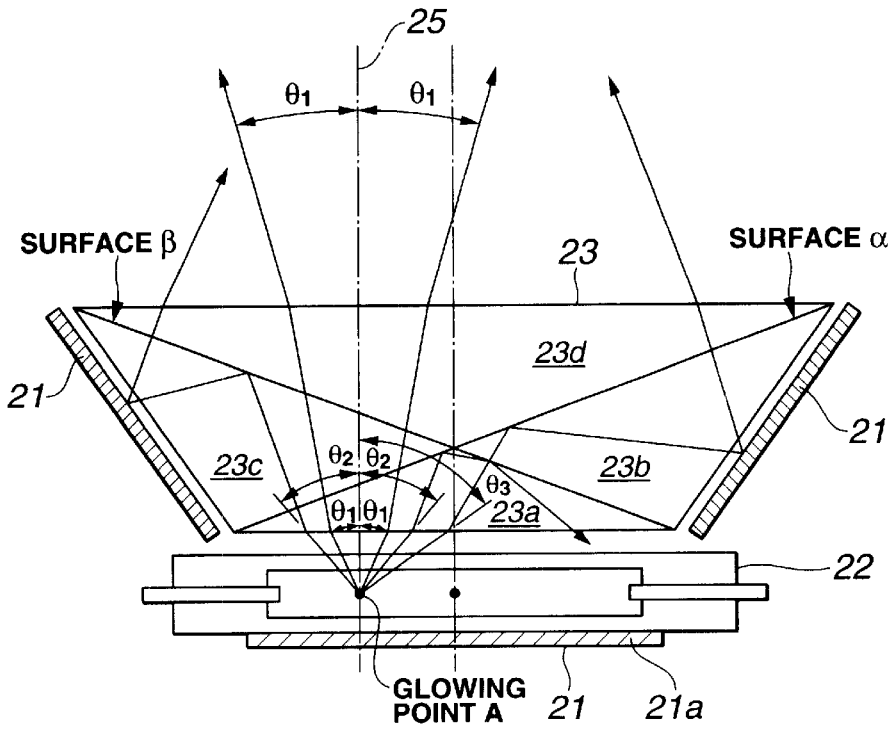
FIG. 2 is a sectional view showing the illumination device which is shown in FIG. 1 and in which a glowing point coincides with any point other than the center of the flash tube.

In the embodiment shown in FIG. 1 and FIG. 2, a prism unit 23 composed of four independent prisms (23*a*, 23*b*, 23*c*, and 23*d*) is encased in a reflector 21. Referring to FIG. 3 to FIG. 6, a description will be made of a structure having a half 231 of the prism unit and the reflector 21 integrated with each other. The half 231 of the prism unit is a wedge-shaped prism composed of a prism 23*a* that is placed near a flash tube 22, and a prism 23*b* opposed to one surface of the prism 23*a*. Herein, air layers formed in the surfaces of the two prisms are omitted.

Figure 3:
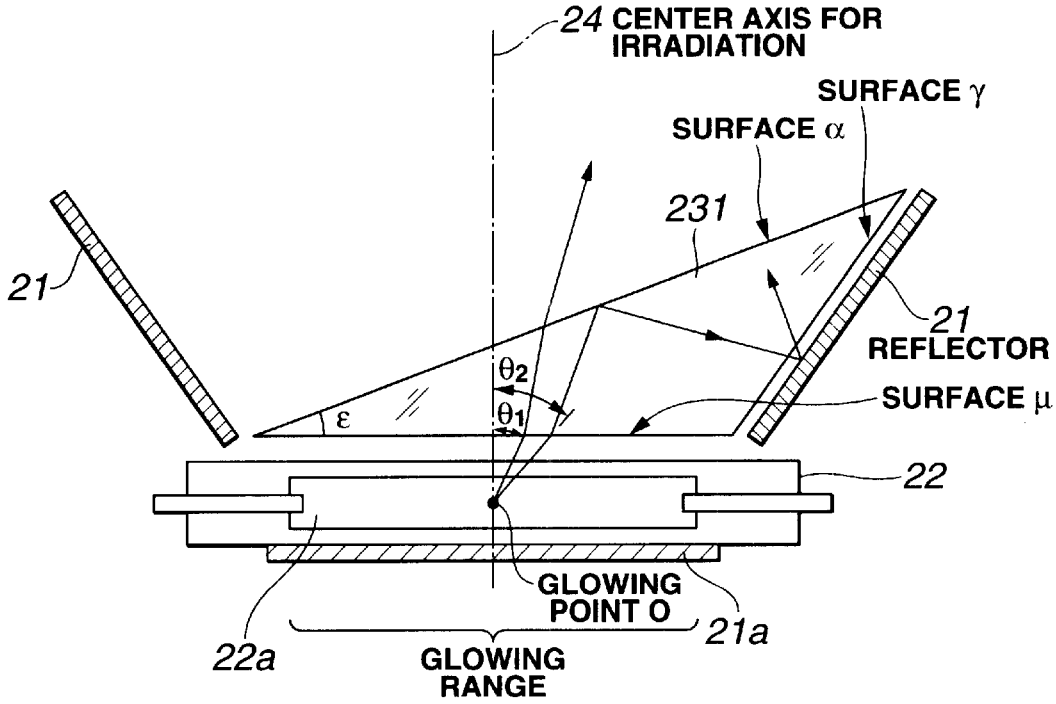
FIG. 3 is a sectional view conceptually showing light that is emitted from the glowing point coincident with the center of the flash tube and introduced to a reflector by utilizing total reflection of a prism.
Figure 4:
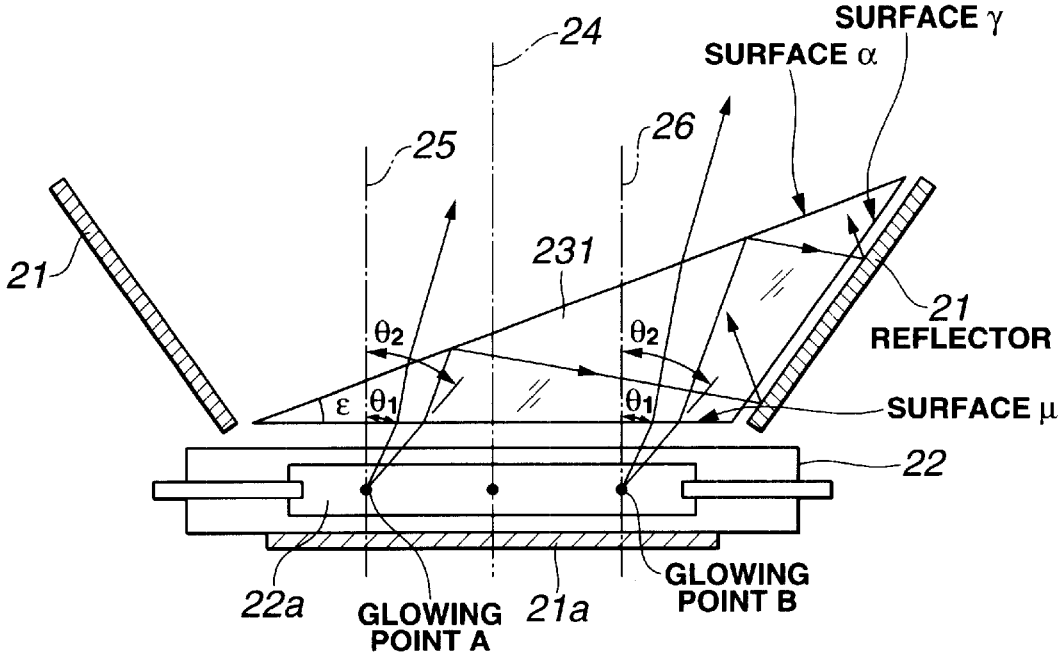
FIG. 4 is a sectional view conceptually showing light that is emitted from the glowing point coincident with any point other than the center of the flash tube and introduced to the reflector by utilizing total reflection of the prism.
Figure 5:
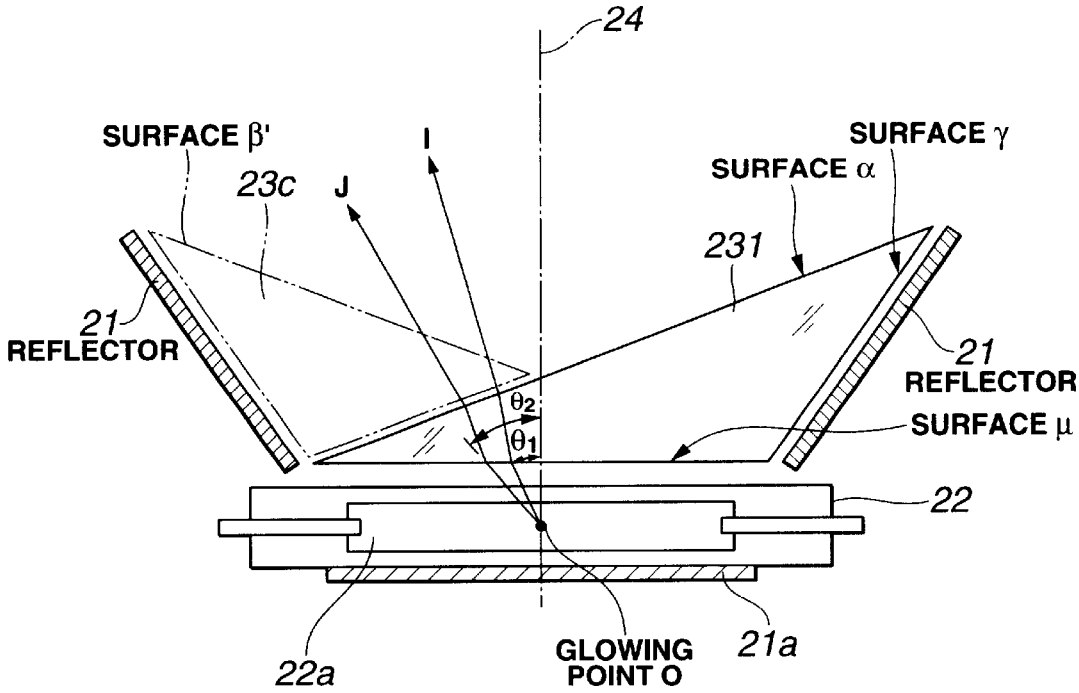
FIG. 5 is a sectional view conceptually showing light that is emitted from the glowing point coincident with the center of the flash tube in a direction opposite to the direction shown in FIG. 3 and introduced to the reflector by utilizing total reflection of the prism.
Figure 22:
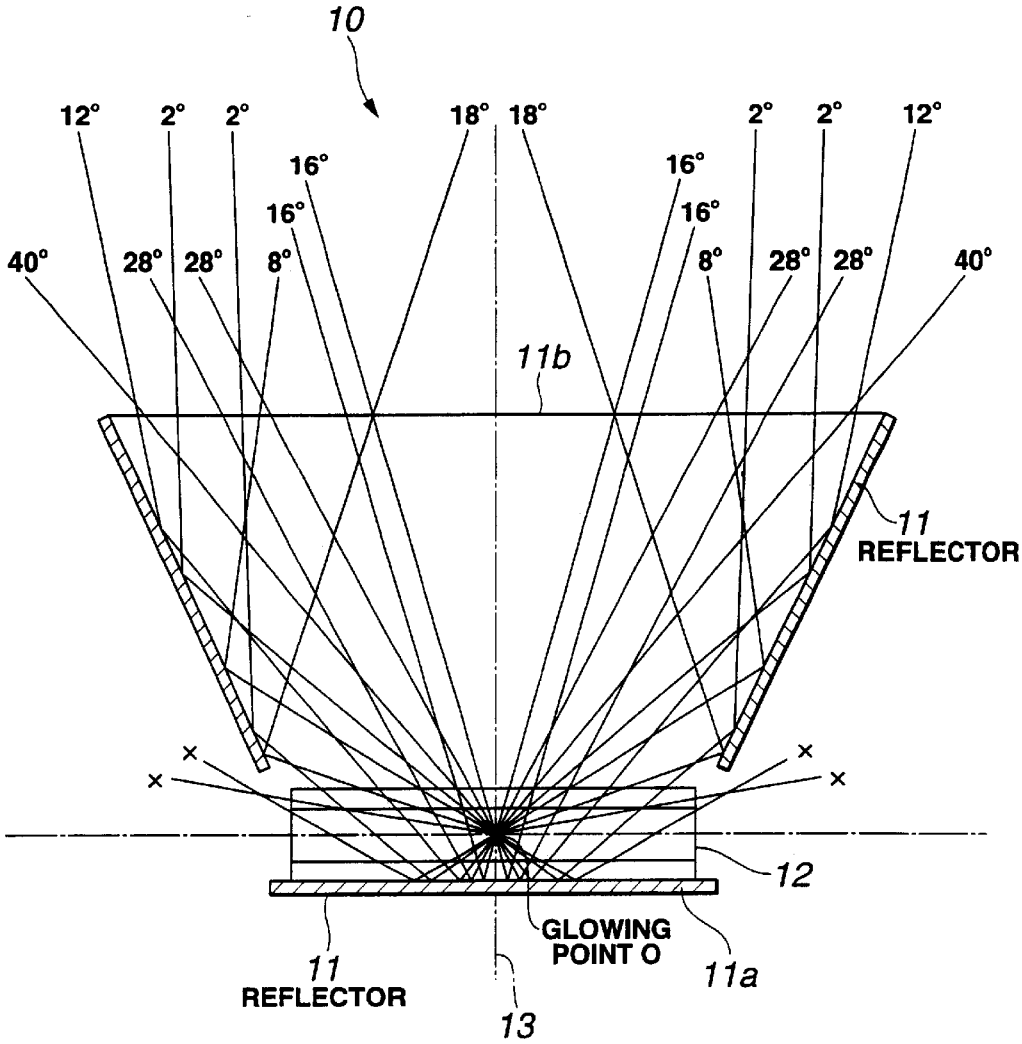
FIG.22 (PRIOR ART)
FIG. 22 shows the traces of light rays, which emanate from a glowing point coincident with the center of a flash tube, in a conventional illumination device that distributes light to a narrow area.
Figure 23:
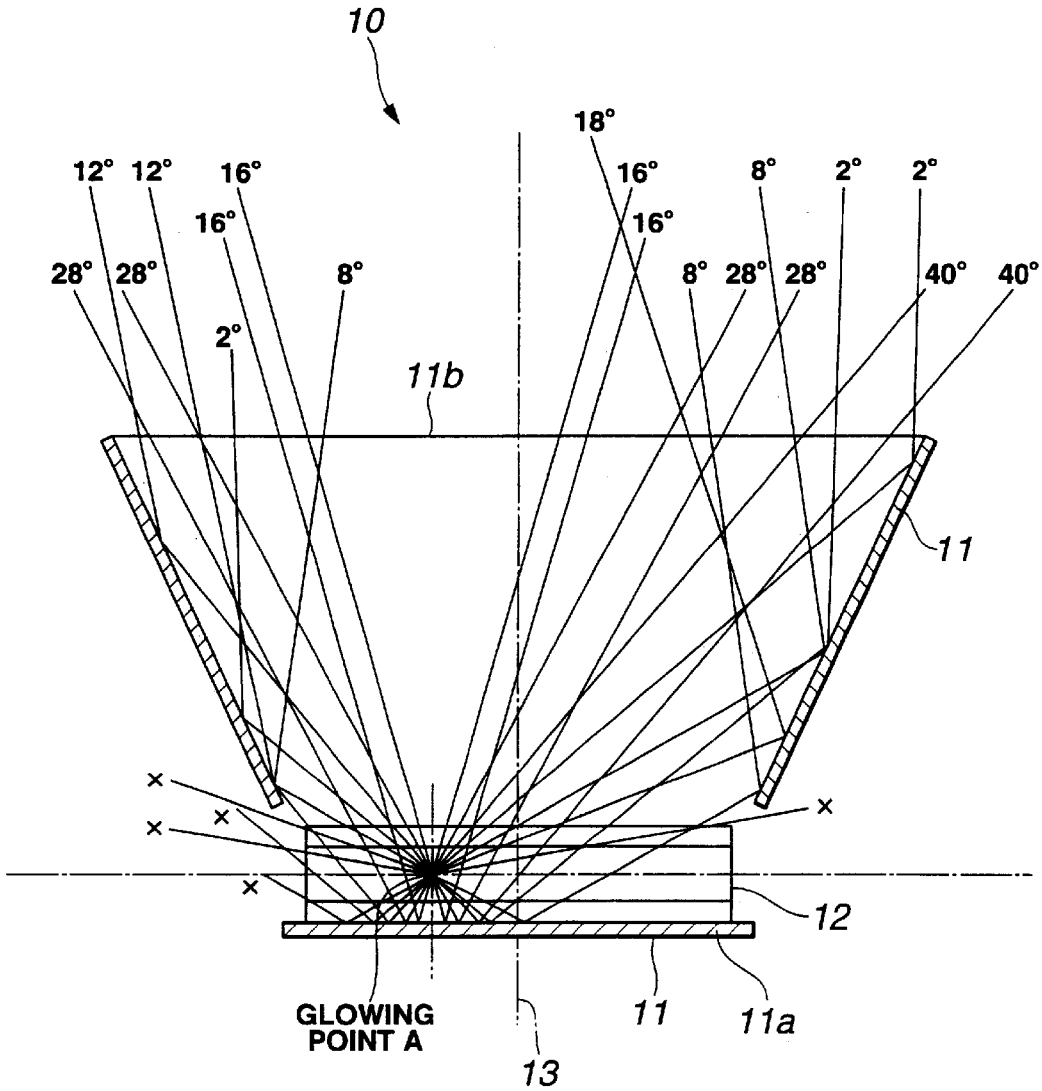
FIG.23 (PRIOR ART)
FIG. 23 shows the traces of light rays, which emanate from a glowing point coincident with any point other than the center of the flash tube, in the conventional illumination device shown in FIG. 22.

A significant difference of the structure shown in FIG. 3 to FIG. 5 from the structure (conventional illumination device) shown in FIG. 22 and FIG. 23 lies in a point that the wedge prism 231 is encased in the reflector. The wedge prism 231 is placed substantially parallel to the flash tube 22 so that one surface (incidence surface) thereof $\mu$ should be close to the longitudinal direction of the flash tube 22. Other surface $\gamma$ of the prism 231 is close to or in contact with the inner surface (shown on the right side) of the reflector 21. In other words, the incidence surface $\mu$ of the wedge prism 231 faces the longitudinal-direction (tube axis-direction) side of a glowing member 22*a* of the flash tube 22, and has a larger length than a glowing range of the glowing member 22*a* does. Another surface $\alpha$ of the prism 231 shares the same edge sides with the incidence surface $\mu$ and surface $\gamma$ respectively. The surface $\gamma$ extends from the border between the inner surface (left lower side of the drawing) of the reflector 21 and the flash tube to the border between the inner surface of the reflector 21 (right upper side of the drawing) and the opening. The surface $\alpha$ is thus inclined at a certain angle $\epsilon$ to the tube-axis direction (longitudinal direction) of the flash tube 22.

FIG. 3 is a sectional view showing the path of light that emanates from a glowing point O, which coincides with the center of the glowing member 22*a* of the flash tube 22, to the right side of the center axis of radiation 24, and that falls on the prism 231. FIG. 4 is a sectional view showing the paths of light rays that emanate from glowing points A and B, which do not coincide with the center of the glowing member 22*a* of the flash tube 22, to the right sides of axes of radiation 25 and 26 respectively, and that fall on the prism 231.

Referring to FIG. 3 and FIG. 4, the flash tube 22 is placed in contact with the inner surface of the back 21*a* of the reflector 21 that has a radial section, or a radially opened section. The prism 231 is encased in the reflector 21. The prism 231 is the aforesaid wedge prism (having two independent prisms 23*a* and 23*b* integrated with each other and being comparable to the half of the prism unit that is shown in FIG. 1 and that will be described later). When the light rays emanating from the glowing points O, A, and B on the glowing member 22*a* of the flash tube 22 fall on the surface $\mu$ of the prism 231, the light rays meet the surface $\mu$ at angles of incidence $\theta 1$ and $\theta 2$ respectively. Moreover, when the incident light ray is transmitted by the surface $\alpha$ of the prism 231, the light ray meets the surface $\alpha$ at the angle of incidence $\theta 1$. When the incident light ray is totally reflected from the surface $\alpha$ of the prism 231, the light ray meets the surface $\alpha$ at the angle of incidence $\theta 2$. Accordingly, a critical angle of total reflection is an intermediate angle between the angles $\theta 1$ and $\theta 2$.

Referring to FIG. 3 and FIG. 4, when light radiated from the glowing member 22*a* of the flash tube 22 to the right side of the axis of radiation 24, 25, or 26 meets the incidence surface $\mu$ of the prism 231 at a small angle of incidence $\theta$ (for example, at the angle of incidence $\theta 1$), the light passes through the incidence surface $\mu$ of the wedge prism 231. The light is finally transmitted by the emitting surface $\alpha$ of the prism 231 that is the transmitting/totally-reflecting surface. When the light meets the incidence surface $\mu$ of the prism 231 at a large angle of incidence (for example, at the angle of incidence $\theta 2$), another phenomenon takes place. That is to say, the light is totally reflected from the transmitting/totally-reflecting surface $\alpha$ of the prism 231.

The light totally reflected from the surface $\alpha$ of the prism 231 is reflected from the reflecting surface of the reflector 21 that is the inner surface thereof. The reflected light is emitted at a certain angle towards the center of the opening of the reflector 21 (that is, forwards), and radiated to outside. In the conventional device (in the case of the prism 231 does no exist) shown in FIG. 22 and FIG. 23, even when light is radiated at an angle of radiation, which corresponds to the incidence angle $\theta$ that the light falls on the prism 231, that is larger than a certain angle, the light passes through the reflector with the angle of radiation held intact. The light is then radiated to outside. Otherwise, when the light is radiated at a larger angle of radiation, the light is reflected from the inner surface of the reflector and radiated to the outside of the reflector. In contrast, in the structure shown in FIG. 3 and FIG. 4, when light is radiated at an angle of radiation that is equal to or larger than a certain angle, part of the light is totally reflected from the surface $\alpha$ of the prism. Herein, the angle of radiation corresponds to the angle of incidence $\theta$ at which the light falls on the prism 231. After the totally-reflected light changes its direction, it is reflected from the inner surface of the reflector 21. Thereafter, the light changes its direction again, and then is directed towards the center of the reflector 21.

In short, in the structure shown in FIG. 3 and FIG. 4, light emitted from the glowing member 22*a* of the flash tube 22 to the right side of the axis of radiation 24, 25, or 26 falls on the prism 231 at the angle of incidence $\theta$ that is an angle to the axis of radiation 24, 25, or 26. If the angle of incidence $\theta$ falls within a predetermined range (for example, equals $\theta 1$), the light is transmitted by the surfaces $\mu$ and $\alpha$ of the prism 231, and then radiated to outside through the opening of the reflector 21. This is substantially identical to the propagation of light that takes place in the conventional device shown in FIG. 22 and FIG. 23. Namely, light emanating from the glowing member of the flash tube passes through the reflector and radiates to outside through the opening of the reflector, though the light is refracted by the prism. However, as shown in FIG. 3 and FIG. 4, light radiated from the glowing member 22*a* of the flash tube 22 to the right side of the axis of radiation 24, 25, or 26 falls on the prism at the angle of incidence $\theta$ that is an angle to the axis of radiation 24, 25, or 26. If the angle of incidence $\theta$ exceeds even a little the predetermined range (for example, equals $\theta 2$), the light is transmitted by the surface $\mu$ of the prism 231, totally reflected from the surface $\alpha$, and then directed towards the inner surface of the reflector 21. The light is then reflected from the inner surface, and finally radiated to outside through the opening of the reflector 21.

When only one wedge prism 231 is included, if consideration is taken into the slope of the reflector 21, light emitted from the glowing point to the right side of the axis of radiation as shown in FIG. 3 and FIG. 4 can be converged on a narrow area ahead of the reflector 21.

FIG. 5 is a sectional view showing a path of light that is emitted from the glowing point O in the center of the glowing member 22*a* of the flash tube 22 to the left side of the center axis of radiation 24 and that falls on the prism 231.

Referring to FIG. 5, light is emitted to the left side of the center axis of radiation 24. In this case, incident light I that meets the incidence surface $\mu$ at the angle of incidence θ1 is, similarly to the aforesaid light that is emitted to the right side of the axis of radiation 24, 25, or 26, and falls on the prism at the angle of incidence θ1 (see FIG. 3 and FIG. 4), transmitted by the incidence surface $\mu$ and then by the transmitting/totally-reflecting surface α. Moreover, incident light J that falls on the prism at an angle of incidence θ2 (identical to the angle of incidence θ2 at which the aforesaid light emitted to the right side of the center axis of radiation 24 falls on the prism) shown in FIG. 5 reaches the transmitting/totally-reflecting surface α after being transmitted by the incidence surface $\mu$. At this time, since an angle at which the light J meets the surface α does not satisfy the condition for total reflection, the light is not totally reflected but emitted by transmitting the surface α. The light J that is emitted to the left side of the center axis of radiation 24 and falls on the prism at the angle of incidence θ2 is transmitted by the prism 231. Thereafter, the light J is not introduced to the inner surface of the reflector 21 (that is, not reflected from the reflector) but radiated to the outside of the reflector 21. Consequently, when only one wedge prism 231 is included, even if light is emitted from the glowing point on the glowing member 22*a* to the left side of the axis of radiation as shown in FIG. 5 at a large angle of radiation (that is, even if the light falls on the surface $\mu$ at a large angle of incidence), the light will not be totally reflected from the emitting surface α. The emitted light is therefore radiated in a specific direction (left upper direction in the drawing). The light is not always converged on a narrow area. Incidentally, a method for overcoming the drawback of poor convergence is that a prism 23*c* (indicated with an alternate long and two short dashes line in FIG. 5) is placed so that one surface of the prism 23*c* will be in contact with the inner surface of the reflector 21 (shown in the left side of the drawing) and other surface thereof will be in contact with the prism 231. In this case, light transmitted by the prism 231 is totally reflected from a surface PI of the prism 23*c*, directed towards the inner surface of the reflector 21, reflected from the inner surface thereof, and finally directed towards the center of the reflector 21. This will be described in conjunction with FIG. 1 and FIG. 2.

Moreover, referring to FIG. 5, a description has been made of a case where light is emitted from the glowing point O in the center of the glowing member 22*a* of the flash tube 22 to the left side of the center axis of radiation 24 in the drawing. Even when light is emitted from a glowing point, which does not coincide with the center of the glowing member 22, to the left side of an axis of radiation that passes through the glowing point, the light is transmitted by the transmitting/totally-reflecting surface a. At this time, the light is transmitted by the transmitting/totally-reflecting surface α irrespective of whether the light falls on the prism at the angle of incidence θ1 or angle of incidence θ2. However, when the glowing point on the flash tube 22 is close to an electrode located in the left side of the illumination device in the drawing, the light that falls on the prism at the angle of incidence θ2 is not radiated to the outside of the reflector 21 as it is after it is transmitted by the emitting surface α. Part of the light is reflected from the inner surface of the reflector 21, and directed to the center of the reflector.

Figure 6:
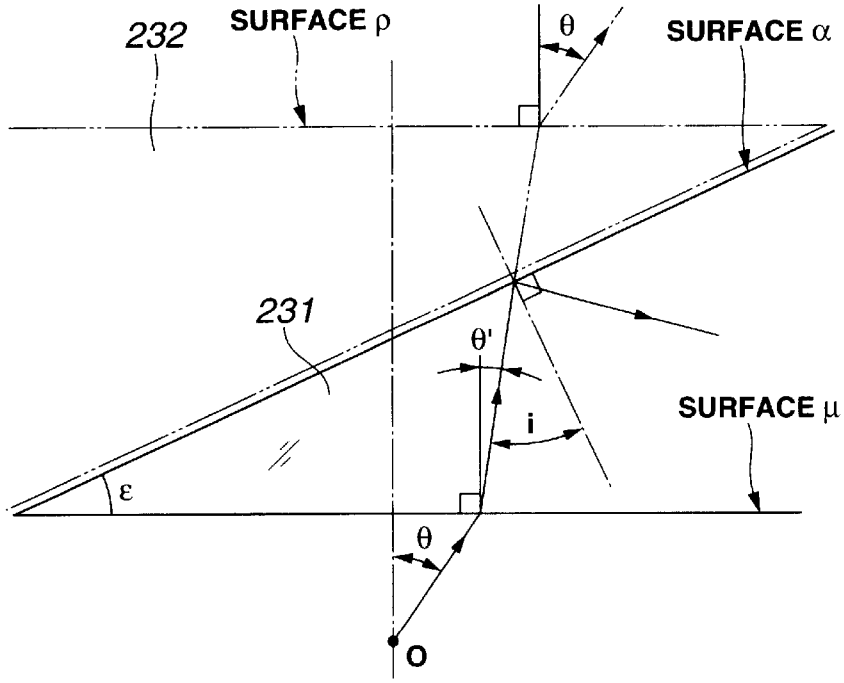
FIG. 6 is an explanatory diagram showing the relationship between the reflecting surface $\epsilon$ of the prism and an angle $\theta$ of light source.

FIG. 6 shows the relationship between the slope ϵ of the reflecting surface α of the prism 231 and the angle θ at which light meets the axis of radiation. Referring to the drawing, light emitted from the glowing point O of the light to the right side of the center axis of radiation 24 falls on the prism 231. The relationship between the slope ϵ of the wedge prism 231 and the angle of incidence θ will be defined below. Herein, the angle of incidence θ is an angle at which light must fall on the prism so that light will be distributed at an angle comparable to an angle of view to be attained for photography.

Furthermore, in the structure (FIG. 6) having the wedge prism 231, which corresponds to a half of the prism unit 23 shown in FIG. 1 and FIG. 2, illumination light (flashlight) that emanates from the glowing member 22*a* of the flash tube 22 and falls on the wedge prism 231 is transmitted or totally reflected from the surface α of the wedge prism 231 according to the angle of incidence θ at which the light falls on the prism. The operation of the illumination light (flashlight) is identical to the one exerted when the wedge prism 231 is integrated with a wedge prism 232 (indicated with an alternate long and two short dashes line in FIG. 6) in order to construct a parallelepiped prism. The wedge prism 232 corresponds to the other half of the prism unit 23. When the wedge prism 231 and wedge prism 232 are integrated with each other, if illumination light (flashlight) is emitted from the wedge prism 232 at an angle θ identical to the angle of incidence θ, the light is transmitted by the parallelepiped prism (refer to transmitted light rays indicated with alternate long and two short dashes lines in FIG. 6). Therefore, the relationship between the angle of incidence θ and the slope ϵ of the prism 231 that is the half of the prism unit 23 and that is indicated with a solid line in FIG. 6 is defined. The angle of incidence θ at which light should fall on the prism unit 23 so that the light will be transmitted by the prism unit 23 is then set to an angle of radiation (angle required to distribute light to an object for photography). The angle of radiation is comparable to an angle of view offered by a photography lens of a camera to which the illumination device is adapted. Consequently, the slope ϵ of the half 231 of the prism unit is calculated in association with the required angle of light distribution θ.

Referring to FIG. 6, assuming that the refractive index of the prism is n' and the refractive index of the atmosphere is n, the following relationship is established:

$$n\sin\theta = n'\sin\theta'$$

Assuming that the critical angle of total reflection is i, the critical angle i is provided as follows:

$$i = \sin^{-1}(n/n')$$

From the relationship shown in FIG. 6, the slope ϵ is expressed as follows:

$$\begin{aligned}\varepsilon &= i - \theta' \\ &= \sin^{-1}(n/n') - \sin^{-1}(n\sin\theta/n')\end{aligned}$$

For example, when a prism whose refractive index n' equals 1.5, the slope ϵ is provided as follows:

$$\epsilon = 41.8 - \sin^{-1}(\sin\theta/1.5)$$

Assuming that the angle θ (which is required to distribute light to an object) is 16°, the slope ϵ is provided as follows:

$$\epsilon = 31.2^\circ$$

When the wedge prism 231 is designed to have the slope ϵ of 31.2°, light that falls on the prism at an angle of incidence smaller than 16° is entirely transmitted by the surface α of the prism 231. Light that falls on the prism at an angle of incidence equal to or larger than 16° is totally reflected from the surface α of the prism 231.

In consideration of a case where the illumination device is used in combination with a wide-angle lens, when the lens has a focal length (f) of 28 mm, the angle of light distribution θ required relative to the longitudinal direction is about 36°. When the lens has a focal length of 24 mm, the angle of light distribution θ is about 40°. Therefore, when θ equals 36°, ϵ equals 18.7°, and when θ equals 40°, ϵ equals 16.4°.

When it is intended to employ a wedge prism in an illumination device for cameras, the slope ϵ of the prism (on the assumption that the refractive index n' equals 1.5) should presumably fall within the following range:

$\epsilon \geqq 15°$ or $\epsilon \leqq 40°$

FIG. 1 and FIG. 2 shows sectional views of an illumination device in accordance with the first embodiment of the present invention.

FIG. 1 is a sectional view showing the paths of light rays that are emitted from a glowing point O in the center of a glowing member 22*a* of a flash tube 22 to the right or left side of the center axis of radiation 24, and that falls on the prism unit 23. FIG. 2 is a sectional view showing the paths of light rays that are emitted from a glowing point A, which lies off the center of the glowing member 22*a* of the flash tube 22, to the right or left side of the axis of radiation 25, and that falls on the prism unit 23.

Referring to FIG. 1 and FIG. 2, an illumination device 20 consists mainly of a reflector 21, a flash tube 22, and a prism unit 23. The reflector 21 serves as a reflecting member whose inner surface is a reflecting surface. The flash tube 22 serves as a light source placed on the inner surface of the back 21*a* of the reflector 21. The prism unit 23 includes at least one prism (in FIG. 1 and FIG. 2, composed of four prisms 23*a* to 23*d*).

The reflector 21 is made of a reflecting material such as a bright aluminum and shaped like an umbrella that opens radially from the back 21*a* thereof. The opening of the reflector through which light is radiated is substantially rectangular. Moreover, the back of the reflector is formed a through hole 21*b*, and the flash tube 22 is penetrated through the through hole 21*b*. The flash tube 22 is thus placed on the inner surface of the back 21*a* of the reflector 21. The diameter of the reflector 21 on the side of the flash tube 22 is larger than the length of the glowing member 22*a* (glowing range) of the flash tube 22.

The flash tube 22 is constituted by a discharge tube such as a xenon flash tube, the glowing member 22*a* and electrode leads 22*b* and 22*c*. The glowing member 22*a* has a gas such as xenon gas sealed in a cylindrically long glass tube. The electrode leads 22*b* and 22*c* are fixed to both the ends of the glowing member 22*a*.

Figure 7:
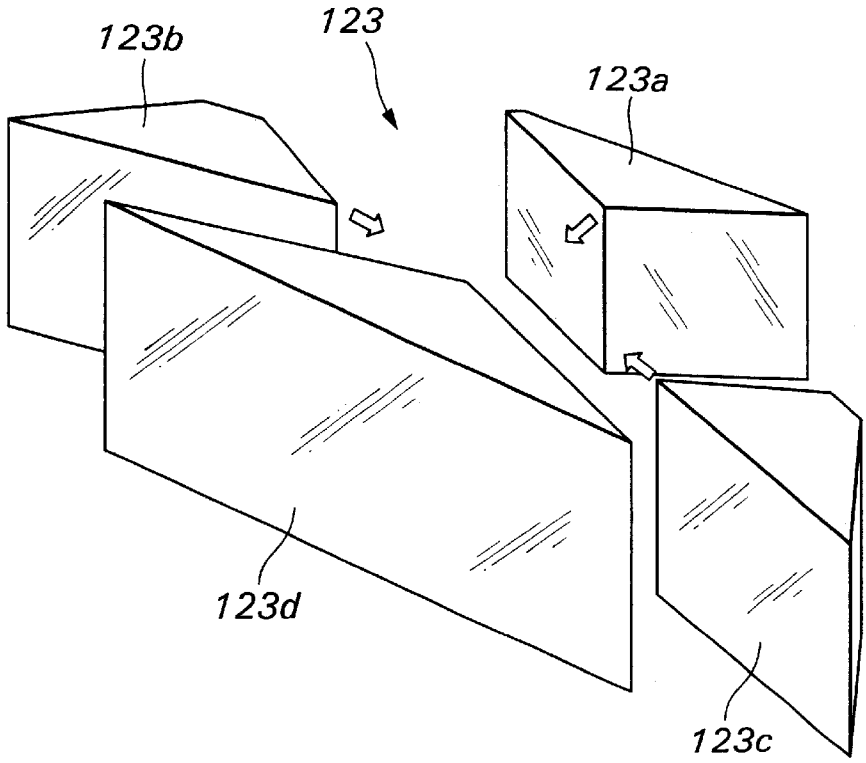
FIG. 7 is an exploded perspective view showing a cross prism unit employed in the first embodiment.
Figure 8:
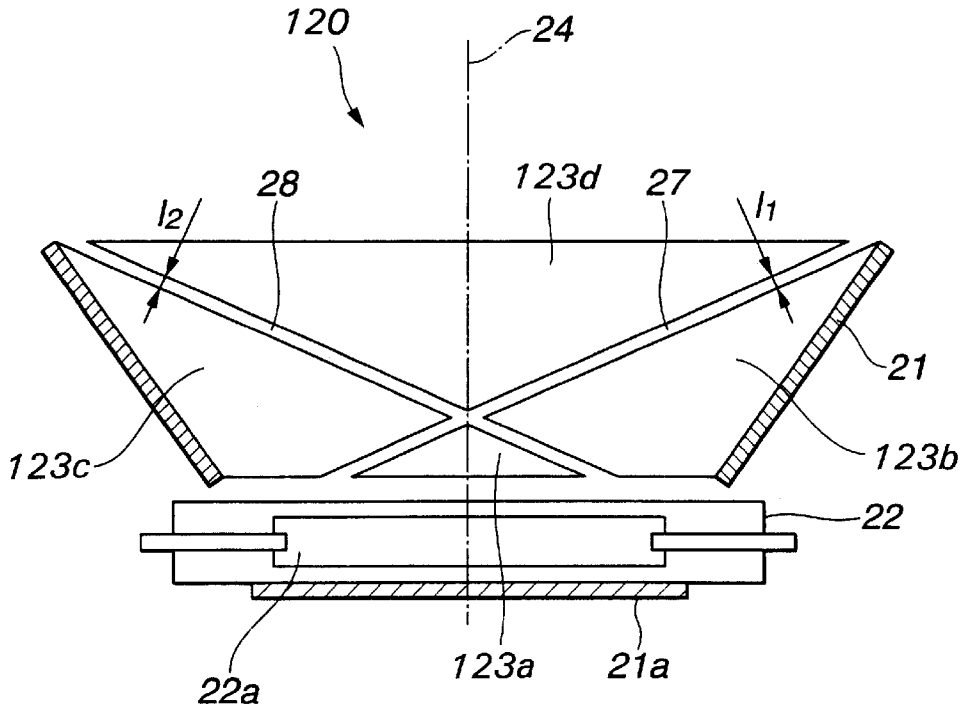
FIG. 8 is a sectional view schematically showing the prisms that are disassembled as shown in FIG. 7 and then assembled in the form of a cross.

The prism unit 23 has four prisms 23*a* to 23*d* mutually closely arranged within air layers 27 and 28 among them as described in conjunction with FIG. 7 and FIG. 8. The air layers form transmitting/totally-reflecting surfaces α and β. The four prisms 23*a* to 23*d* constitute a parallelepiped prism (whose surfaces μ and ρ are parallel to each other). The four prisms 23*a* to 23*d* are engaged with the inner surface of the reflector 21. The prisms are made of a transparent material such as a glass or a synthetic resin.

The prism unit 23 is located in front of the flash tube 22. The prism unit 23 has an incidence surface μ, first and second transmitting/totally-reflecting surfaces α and β, and an emitting surface ρ. Light diverging from the flash tube 22 falls on the incidence surface μ. The first and second transmitting/totally-reflecting surfaces α and transmit or totally reflect light, which has passed through the incidence surface μ, according to an angle of incidence θ at which the light meets the incidence surface. The emitting surface ρ finally radiates the light, which is transmitted or totally reflected from the first and second transmitting/totally-reflecting surfaces α and β, forwards.

The first and second transmitting/totally-reflecting surface α and β transmit or totally reflect light, which has passed through the incidence surface μ, according to the angle of incidence θ at which the light meets the incidence surface. The first and second transmitting/totally-reflecting surfaces α and β are opposed substantially entirely to the longitudinal direction of the flash tube 22 so that transmitted light will be radiated forwards and totally-reflected light will be directed laterally. The first and second transmitting/totally-reflecting surfaces α and β are formed substantially symmetrically to each other in the longitudinal direction of the flash tube 22 with respect to the center axis of radiation 24 in the illumination device 20. The first and second transmitting/totally-reflecting surfaces α and β cross each other near the center axis of radiation 24.

Next, the operations of the present embodiment will be described with reference to FIG. 1 and FIG. 2.

As shown in FIG. 1, light emitted at a small angle, which is equal to or smaller than θ1, relative to the center axis of radiation 24 enters the prism unit 23, and passes through the surfaces thereof α and β. The light is then radiated from the prism unit 23 at the small angle that is equal to or smaller than θ1. Herein, θ1 denotes an angle of incidence that is a little smaller than an angle of incidence corresponding to a critical angle of total reflection at which total reflection occurs on the surface α or β. When the illumination device is adapted to a camera, θ1 corresponds to an angle of light distribution that is required to illuminate a photographic area corresponding to an area defined with an angle of view offered by a photography lens.

Light is emitted to the right or left side of the center axis of radiation 24 by an angle larger than θ1 (for example, θ2 larger than the critical angle of total reflection in FIG. 1). The light emitted to the right side thereof is totally reflected from the surface α. Moreover, the light emitted to the left side of the center axis of radiation 24 is totally reflected from the surface β. The light totally reflected from the surfaces α and β is further reflected from the inner surface of the reflector 21. (Incidentally, light may be totally reflected from the lateral surfaces γ and δ of the prism, though it depends on an angle of incidence at which the light falls on the surfaces.)

The light reflected from the reflector may be transmitted by the prisms 23*b*, 23*c*, and 23*d*, and radiated from the emitting surface ρ to the outside at an angle equal to or smaller than θ1 (an angle smaller than the angle of light distribution needed to perform photography).

As shown in FIG. 2, when light is emitted from the glowing point A that lies off the center of the flash tube 22, as long as the light is emitted at the angle equal to or smaller than θ1, the light is radiated in the same manner as it is shown in FIG. 1.

Light emitted at an angle θ2 or θ3 larger than θ1 is totally reflected from the surface α or β and introduced to the reflector 21. The light is further reflected from the inner surface of the reflector 21. (However, for example, when light is emitted from the point A at the angle θ2 to the right side of the axis of radiation 25 as shown in FIG. 2, the light is totally reflected twice, that is, totally reflected from both the surfaces α and β. The light totally reflected twice is not introduced to the reflector 21.)

The light reflected from the reflector may be transmitted by the prism 23*b* or 23*c* and the prism 23*d*, and radiated from the emitting surface ρ to outside at an angle equal to or smaller than θ1.

FIG. 7 is an exploded perspective view of the four prisms 123*a* to 123*d* constituting a prism unit 123. FIG. 8 is a sectional view showing, for a better understanding, how the prisms 123*a* to 123*d* shown in FIG. 7 are integrated with one another and encased in the reflector 21 in order to construct the illumination device 120.

Referring to FIG. 8, the prisms 123*a* to 123*d* shown in FIG. 7 are mutually closely arranged with narrow air layers 27 and 28 among them in order to construct the prism unit 123 that is parallelepiped. The prism unit 123 is encased in the reflector 21 and combined with the flash tube 22, whereby the illumination device 120 is constructed.

The air layer 27 has a substantially uniform width 11 so as to constitute the first transmitting/totally reflecting surface α. The air layer 28 has a substantially uniform width 12 so as to constitute the second transmitting/totally-reflecting surface β, with being symmetrical to the air layer 27 in the longitudinal direction of the flash tube 22 with respect to the center axis of radiation 24 of the illumination device 20. The width 11 and width 12 are normally set to the same value. The air layer 27 and air layer 28 cross each other near the center axis of radiation 24.

Moreover, in the prism unit 23 composed of the prisms 23*a* to 23*d*, or 123*a* to 123*d*, and shown in FIG. 1 and FIG. 2, or FIG. 7 and FIG. 8, the assembly of the three prisms 23*a* to 23*c*, or 123*a* to 123*c*, is integrated with the prism 23*d* or 123*d* in order to construct a parallelepiped prism unit. Consequently, light emanating from the flash tube 22 at an angle of radiation (equals an angle of incidence) θ is not totally reflected from the surfaces α and β (see FIG. 6), the light is radiated from the emission surface ρ at the same angle of radiation θ.

According to the present embodiment, the surfaces α and β defined by the three prisms 23*a* to 23*c*, or 123*a* to 123*c*, draw a transmissive or totally reflective cross. The concept that light is efficiently converged owing to the transmissive or totally reflective surfaces α and β that cross each other is established basically. This signifies that as long as the transmitting/totally-reflecting surfaces α and β are present, the prism 23*d* or 123*d* may be absent. In reality, the prism 23*d* or 123*d* out of the prisms 23*a* to 23*d*, or 123*a* to 123*d*, constituting the prism unit 23 or 123 may be excluded. Nevertheless, an angle of radiation at which light is radiated from the reflector 21 merely changes a little. The prism 23*d* or 123*d* may therefore be excluded. In other words, even if the prism 23*d* or 123*d* is excluded, as long as the slope of the surfaces α and β is set to an appropriate value, light can be converged efficiently on an intended area.

Also, in the prism unit 23 or 123 composed of the prisms 23*a* to 23*d*, or 123*a* to 123*d*, and shown in FIG. 1 and FIG. 2, or FIG. 7 and FIG. 8, the prisms 23*a* to 23*c*, or 123*a* to 123*c*, out of the prisms 23*a* to 23*d*, or 123*a* to 123*d*, constituting the prism unit 23 or 123 may not be integrated with one another with the air layers 27 and 28 among them as shown in FIG. 8. Alternatively, the three prisms 23*a* to 23*c*, or 123*a* to 123*c*, may be mutually closely or fully integrated with one another, and the prism 23*d* or 123*d* may be integrated with the integrated prisms with air layers between them. The thus constructed prism unit can provide nearly the same capability as the one shown in FIG. 1 and FIG. 2, or FIG. 7 and FIG. 8. As mentioned above, light that is emitted from the point A to the right side of the axis of radiation 25 as shown in FIG. 2 and that falls on the prism unit at the angle of incidence θ2 is totally reflected twice, that is, totally reflected from both the surfaces α and β. The light is not introduced to the reflector 21 but wasted. However, when the three prisms 23*a* to 23*c*, or 123*a* to 123*c*, are mutually closely or fully integrated with one another, the surfaces α and β that are located on the side of the flash tube beyond the cross point are not formed. No light is therefore totally reflected twice, that is, totally reflected from both the surfaces α and β. Instead, since light is emitted forwards, the light is utilized effectively.

Figure 9:
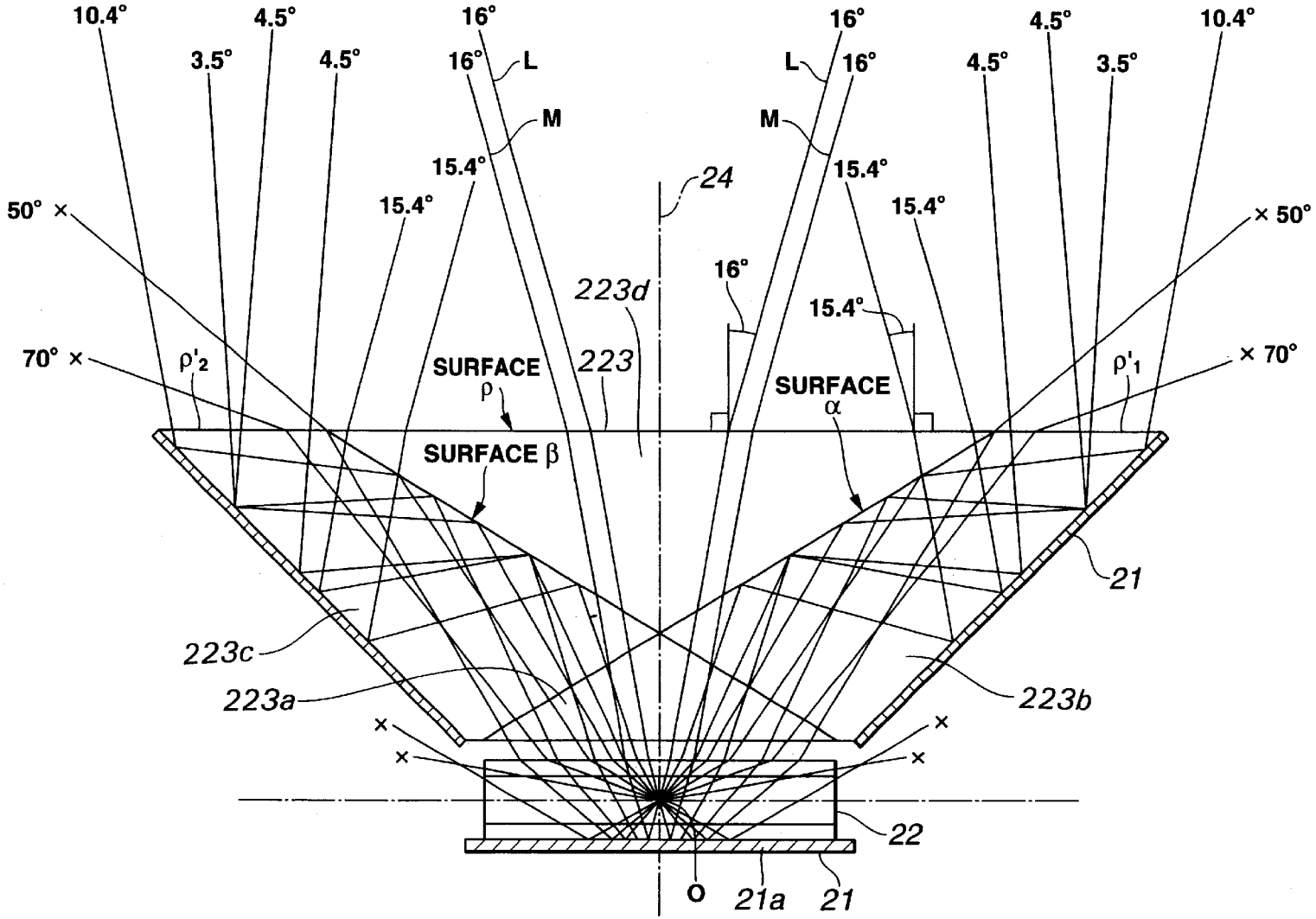
FIG. 9 shows traces of light rays, which emanate from a glowing point coincident with the center of the flash light, in the illumination device shown in FIG. 1 and FIG. 2.
Figure 10:
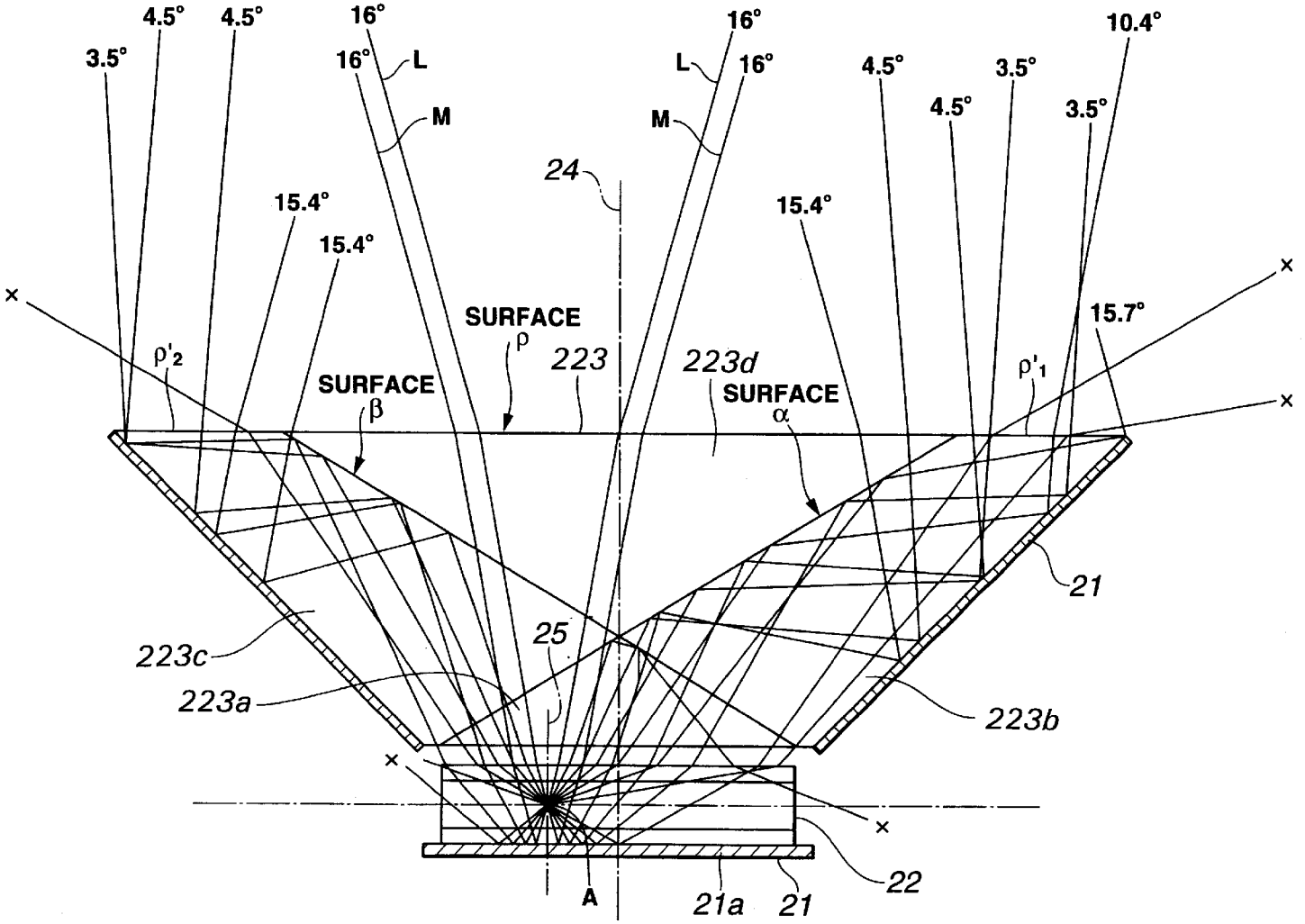
FIG. 10 shows the traces of light rays, which emanate from a glowing point coincident with any point other than the center of the flash tube, in the illumination device shown in FIG. 9.

FIG. 9 and FIG. 10 show the traces of light rays propagated by the illumination device of the present embodiment shown in FIG. 1 and FIG. 2. However, FIG. 9 and FIG. 10 show a compact illumination device having a smaller depth in which the emitting-surface portions of the prisms 23*b*, 23*c* and 23*d* shown in FIG. 1 and FIG. 2 are cut out. Consequently, the cut surfaces p of the prisms constitute an emitting surface. Nevertheless, the prism unit 223 itself is parallelepiped.

FIG. 9 shows the traces of light rays that emanate from the glowing point O in the center of the glowing member of the flash tube 22 towards the right or left side of the center axis of radiation 24, and that fall on the prism unit 223.

As shown in FIG. 9, assume that an angle of light distribution that is required to illuminate a photographic area and corresponds to an angle of view offered for photography is, for example, 16°. The angle of 16° shall be a little smaller than an angle of incidence equivalent to the critical angle of total reflection that brings about total reflection on the transmitting/totally-reflecting surfaces α and α of the prisms 223*b* and 223*c*. (Incidentally, the relationship between the angle of incidence θ (critical angle) at which light falls on the prism to totally reflect from the transmitting/totally-reflecting surface α or β and the slope ε of the surfaces α and β of the wedge prisms is defined as mentioned in conjunction with FIG. 6)

Light that emanates from the glowing point O at an angle of radiation equal to or smaller than 16° and falls on the prism unit 223 traces a path that lies within a range between paths L and entirely radiates forwards. Moreover, light emanating from the glowing point O, reflecting forwards from the back plate 21*a* of the reflector 21, and falling on the prism unit 223 at an angle equal to or smaller than 16° traces a path that lies within a range between paths M and entirely radiates forwards. These light rays work effectively.

In contrast, a majority of light that emanates forwards from the glowing point O and falls on the prism unit 223 at an angle equal to or larger than an angle of incidence (critical angle) which causes total reflection to occur on the surfaces α and β is, as illustrated, totally reflected from the surfaces α and β. Moreover, a majority of light that emanates from the glowing point O, reflects forwards from the back plate 21*a* of the reflector 21, and falls on the prism unit 223 at an angle equal to or larger than the angle of incidence (critical angle) which causes total reflection to occur on the surfaces α and β is, as illustrated, totally reflected from the surfaces α and β. These light rays are introduced to the inner surface (reflecting surface) of the reflector 21, reflected from the reflecting surface again, and transmitted by the prisms 223*a*, 223*b*, 223*c*, and 223*d*. Thereafter, the light rays are radiated forwards from the surface ρ of the prism 223*d* and the emitting surfaces ρ1' and ρ2' of the prisms 223*b* and 223*c* that is contained on the same plane as the surface ρ. At this time, the light rays are radiated forwards from the surfaces ρ, ρ1', and ρ2' at angles of radiation of, as illustrated, 3.5°, 4.5°, 10.4°, and 15.4° that are smaller than the angle of light distribution of 16° required to illuminate a photographic area. These light rays work effectively.

Moreover, part of light emanating forwards from the glowing point O and falling on the prism unit 223 at an angle equal to or larger than an angle of incidence (critical angle) that causes total reflection to occur on the surfaces α and β is, as illustrated, not totally reflected from the surfaces α and β. Moreover, part of light emanating from the glowing point O, reflecting forwards from the back plate 21*a* of the reflector 21, and falling on the prism unit 23 at an angle equal to or larger than the angle of incidence (critical angle) that causes total reflection to occur on the surfaces α and β is not totally reflected from the surfaces α and β. These light rays are transmitted by the prisms 223*b* and 223*c*, and radiated from the emitting surfaces ρ1' and ρ2' of the prisms 223*b* and 223*c* at a considerably large angle of 50° or 70° (that disables the light rays to work effectively to illuminate a photographic area). The emitting surfaces ρ1' and ρ2' are exposed on the same plane as the emitting surface ρ. A mark x indicates a light ray that is not utilized effectively.

Also, FIG. 10 shows the traces of light rays that emanate from the glowing point A, which lies off the center of the glowing member of the flash tube 22 included in the same illumination device as that shown in FIG. 9, to the right or left side of the axis of radiation 25, and that then fall on the prism unit 223. As shown in FIG. 10, light emanating forwards from the glowing point A and falling on the prism unit 223 at an angle equal to or smaller than 16° traces a path that lies within a range between paths L. Light emanating from the glowing point A, reflecting from the back plate 21*a* of the reflector 21, and falling on the prism unit 223 at an angle that is equal to or smaller than 16° and that is equivalent to an angle of radiation traces a path that lies within a range between paths M. The light rays radiate entirely forwards and therefore work effectively.

On the other hand, a majority of light emanating forwards from the glowing point A and falling on the prism unit 223 at an angle equal to or larger than an angle of incidence (critical angle) that causes total reflection to occur on the surfaces α and β is, as illustrated, totally reflected from the surfaces α and β. Moreover, a majority of light emanating from the glowing point A, reflecting forwards from the back plate 21*a* of the reflector 21, and falling on the prism unit 223 at an angle equal to or larger than the angle of incidence (critical angle) that causes total reflection to occur on the surfaces α and β is, as illustrated, totally reflected from the surfaces α and β. These light rays are introduced to the inner surface (reflecting surface) of the reflector 21, reflected from the reflecting surface again, and transmitted by the prisms 223*a*, 223*b*, 223*c*, and 223*d*. The light rays are then radiated forwards from the surface p of the prism 223*d* and the surfaces ρ1' and ρ2' of the prisms 223*b* and 223*c* that are exposed on the same plane as the surface ρ. At this time, the light rays are radiated forwards from the surfaces ρ, ρ1', and ρ2' at angles of radiation of, as illustrated, 3.5°, 4.5°, 10.4°, 15.4°, and 15.7° that are smaller than the angle of light distribution of 16° required to illuminate a photographic area. These light rays work effectively. Moreover, part of light emanating forwards from the glowing point A and falling on the prism unit 223 at an angle equal to or larger than an angle of incidence (critical angle) that causes total reflection to occur on the surfaces α and β is not totally reflected from the surfaces α and β. Moreover, part of light emanating from the glowing point A, reflecting forwards from the back plate 21*a* of the reflector 21, and falling on the prism unit 223 at an angle equal to or larger than the angle of incidence (critical angle) that causes total reflection to occur on the surfaces α and β is not totally reflected from the surfaces α and β. These light rays are transmitted by the prisms 223*b* and 223*c*, and radiated from the emitting surfaces ρ1' and ρ2' of the prisms 223*b* and 223*c*, at an angle considerably larger than 50° (a large angle of radiation that disables light to work effectively). The emitting surfaces ρ1' and ρ2' are exposed on the same plane as the emitting surface ρ. A mark x indicates a light ray that is radiated to an area outside a photographic area (16°) and therefore not used effectively.

As apparent from the description made in conjunction with FIG. 9 and FIG. 10, the cross-drawn prism unit 223 having the transmitting/totally-reflecting surfaces α and β that cross each other is encased in the reflector 21. Light that when the conventional structure (FIG. 22 and FIG. 23) is employed, is radiated to an area outside a photographic area and thus wasted can be converged on an effective area. As long as the flash tube 22 emits the same amount of light, a larger amount of light can be converged on an effective photographic area. This leads to effective (efficient) use of light. Moreover, if an amount of light to be radiated to a photographic area may be the same as an amount of light conventionally radiated, a flash tube capable of emitting a smaller amount of light may be adopted. This is cost-effective.

Figure 11A:
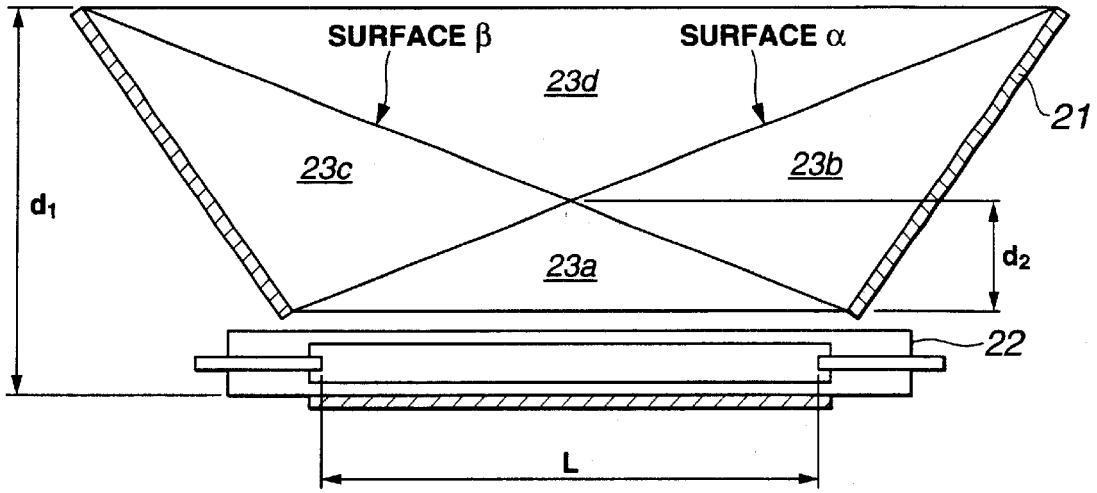
FIG. 11A and FIG. 11B are sectional views concerning a method for designing an illumination device compactly.
Figure 11B:
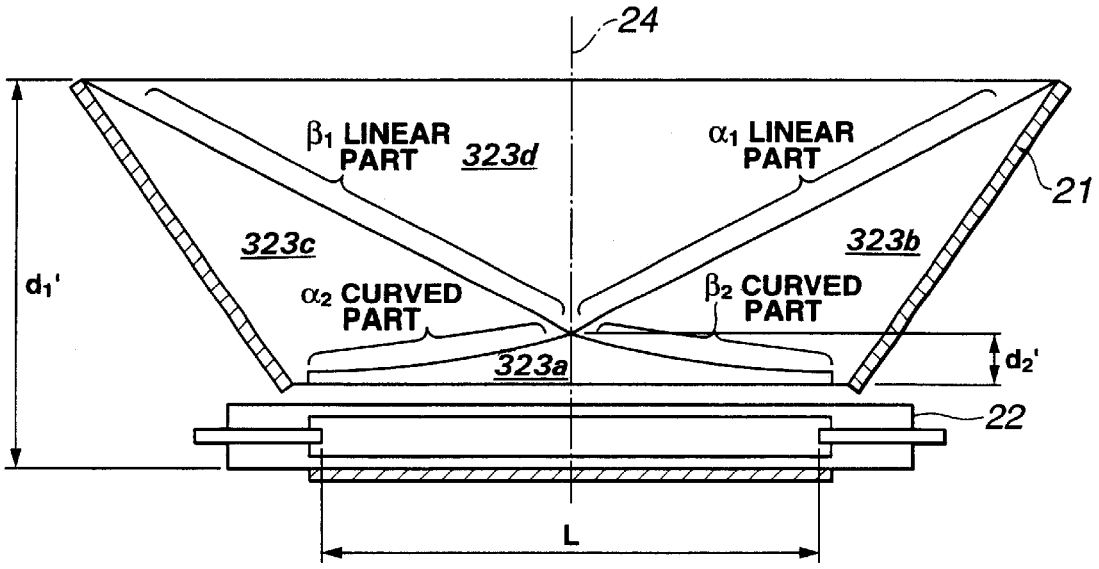

FIG. 11A and FIG. 11B are explanatory diagrams concerning a method of designing an illumination device more compactly according to the present invention.

The illumination device shown in FIG. 11A is identical to that shown in FIG. 1 and FIG. 2. The four prisms constituting the prism unit 23 encased in the reflector 21 are arranged so that the transmitting/totally-reflecting surfaces α and β cross each other on a planar basis, that is, linearly near the center axis of radiation. As a method for designing this type of illumination device thinly, that is, compactly, the portions of the transmitting/totally-reflecting surfaces α and β of the prisms 323*b* and 323*c* that are in contact with the prism 323*d* are formed as flat surfaces, that is, linear parts α1 and β1 as shown in FIG. 11B. The portions of the transmitting/totally-reflecting surfaces α and β that are in contact with the prism 323*a* are formed as curved surfaces, that is, curved parts α2 and β2. Thus, the width (depth) of the prism 323*a* is compressed from a width d2 to a width d2' (d2'<d2).

Figure 12:
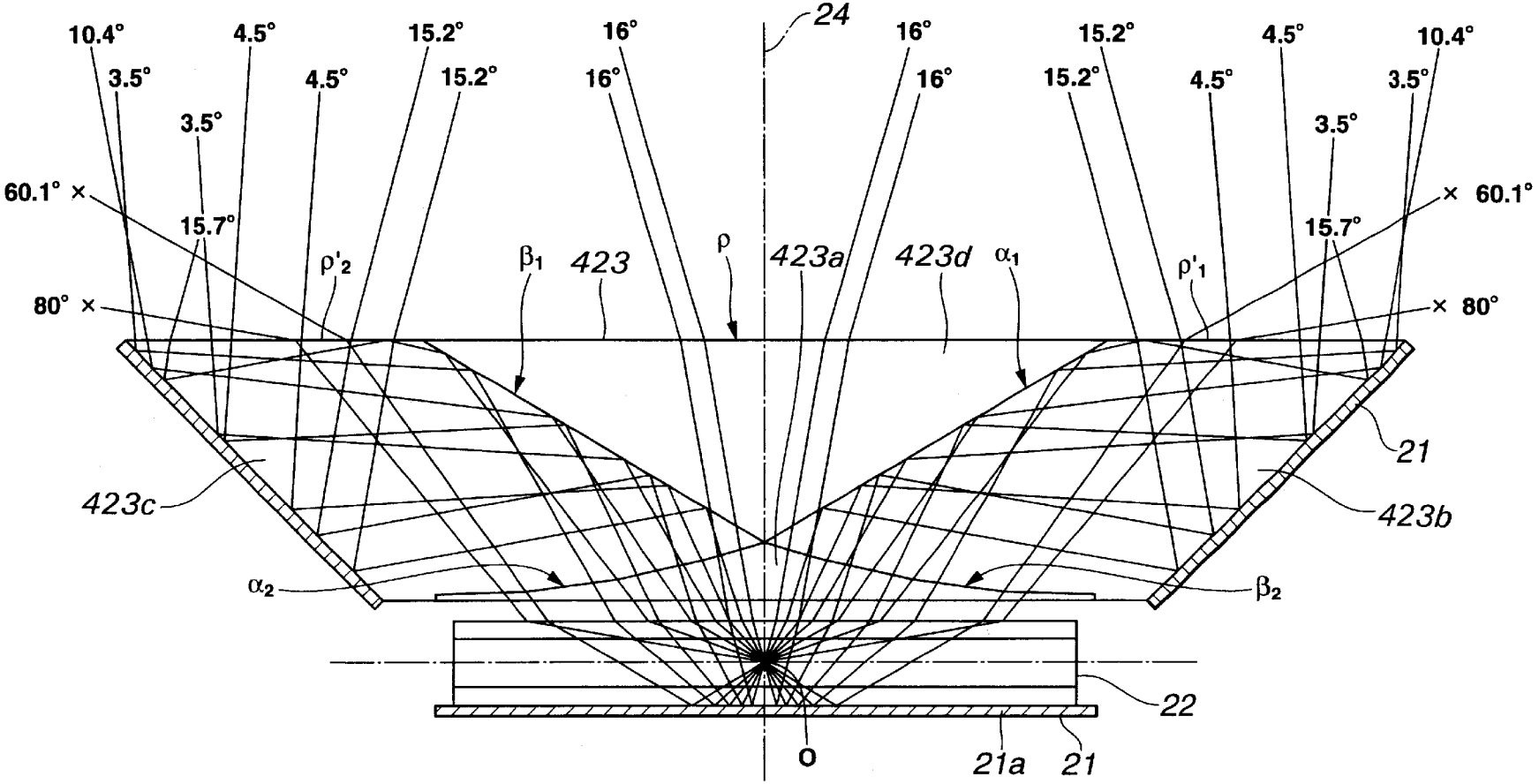
FIG. 12 shows the traces of light rays, which emanate from a glowing point coincident with the center of a flash tube, in an illumination device in accordance with a second embodiment of the present invention.
Figure 13:
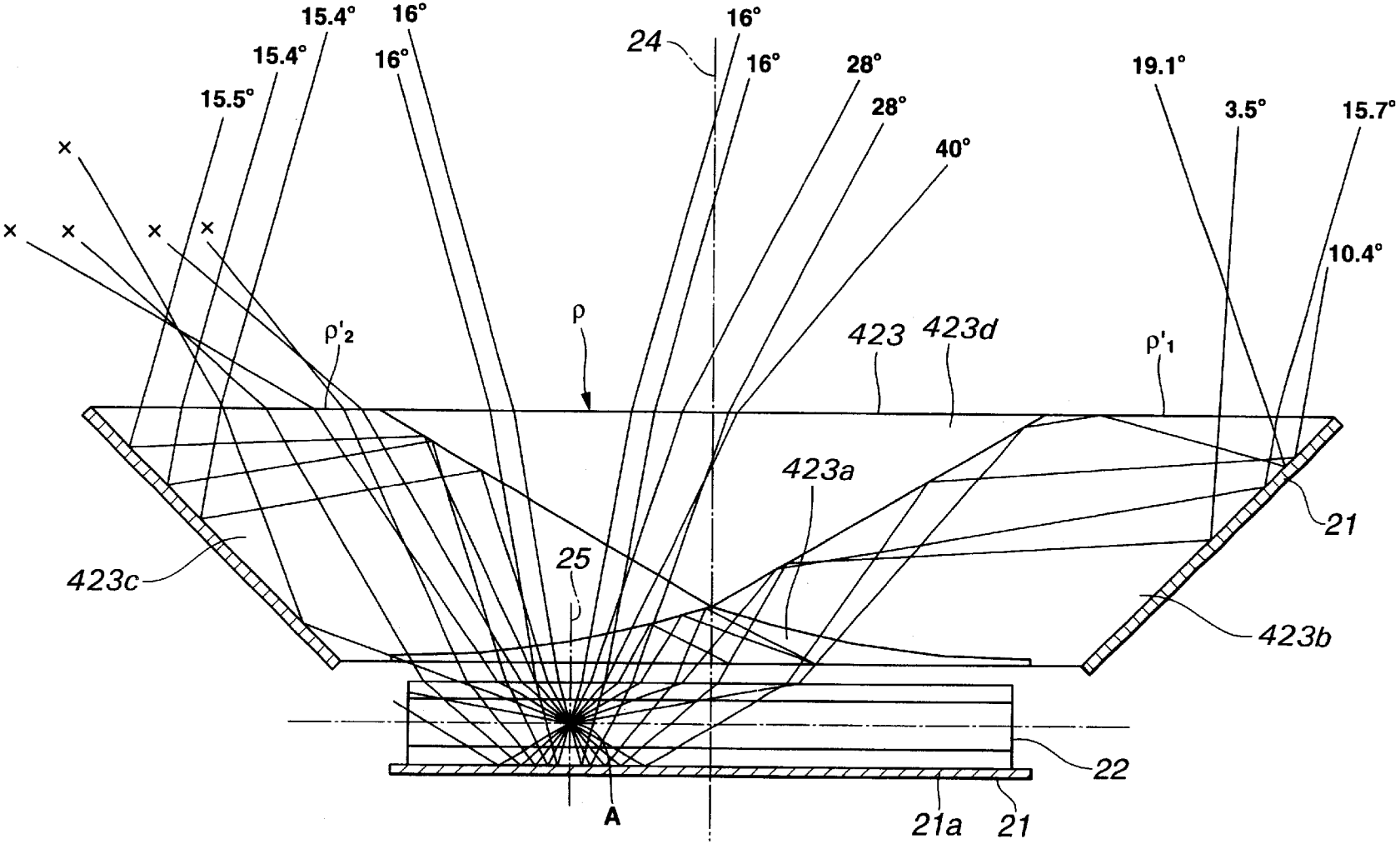
FIG. 13 shows the traces of light rays, which emanate from a glowing point coincident with any point other than the center of the flash tube, in the illumination device shown in FIG. 12.

FIG. 12 and FIG. 13 are sectional views showing an illumination device in accordance with a second embodiment of the present invention.

FIG. 12 and FIG. 13 show the illumination device that is designed thinly, that is, compactly by adopting both the method described in conjunction with FIG. 11B and the method described in conjunction with FIG. 9 and FIG. 10 (method of cutting the surface ρ-side portion of the prism). In FIG. 9 and FIG. 10, the same reference numerals are assigned to the same components.

FIG. 12 shows the traces of light rays that are emitted from the glowing point O in the center of the glowing member of the flash tube 22 to the right or left side of the center axis of radiation 24 and that fall on the prism 423.

Also, FIG. 13 shows the traces of light rays that are emitted from the glowing point A, which lies off the center of the glowing member of the flash tube 22 included in the right or left side of the axis of radiation 25, and that fall on the prism 423. Herein, an angle of radiation at which effective light is emitted is 16° or less.

In the embodiment shown in FIG. 12 and FIG. 13, similarly to the embodiment shown in FIG. 9 and FIG. 10, the prism unit 423 whose transmitting/totally-reflecting surfaces α and β cross each other is encased in the reflector 21. Thus, light that is radiated to an area outside a photographic area and wasted with the use of the conventional structure (FIG. 22 and FIG. 23) can be converged at an effective area.

Consequently, as long as the flash tube 22 emits the same amount of light, a larger amount of light can be converted on an effective photographic area. Light is thus used effectively (efficiently). Moreover, if an amount of light to be radiated to a photographic area may be the same as an amount of light conventionally radiated, a flash tube capable of emitting a smaller amount of light may be adopted. This is cost-effective. However, compared with the structure shown in FIG. 9 and FIG. 10, the structure shown in FIG. 12 and FIG. 13 is slightly poor at converging light. For example, the number of invalid light rays shown in FIG. 13 emitted at an angle of radiation exceeding an effective range of 16° or less (indicated with a mark x) is a bit larger than the number of invalid light rays shown in FIG. 10.

In the foregoing embodiment, the slope $\epsilon$ of the transmitting/totally-reflecting surfaces $\alpha$ and $\beta$ is preferably set to a range from 15° to 40° relative to the longitudinal direction of the flash tube 22, though it depends on an angle of view offered by a photography lens employed in a camera.

Figure 14:
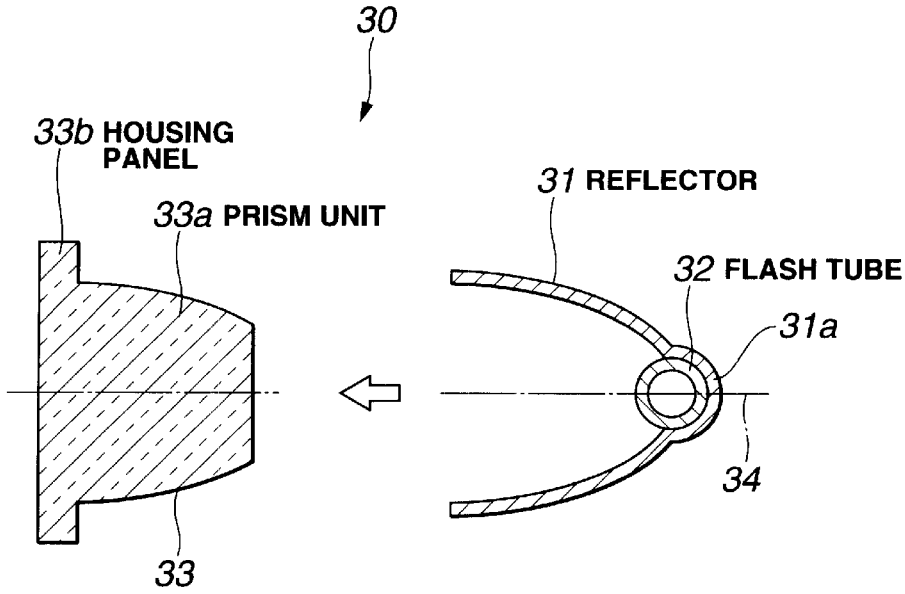
FIG. 14 is an exploded sectional view showing a prism unit that has been composed integratelly with a housing panel and is being encased in a reflector included in an illumination device in accordance with a third embodiment of the present invention.
Figure 15:
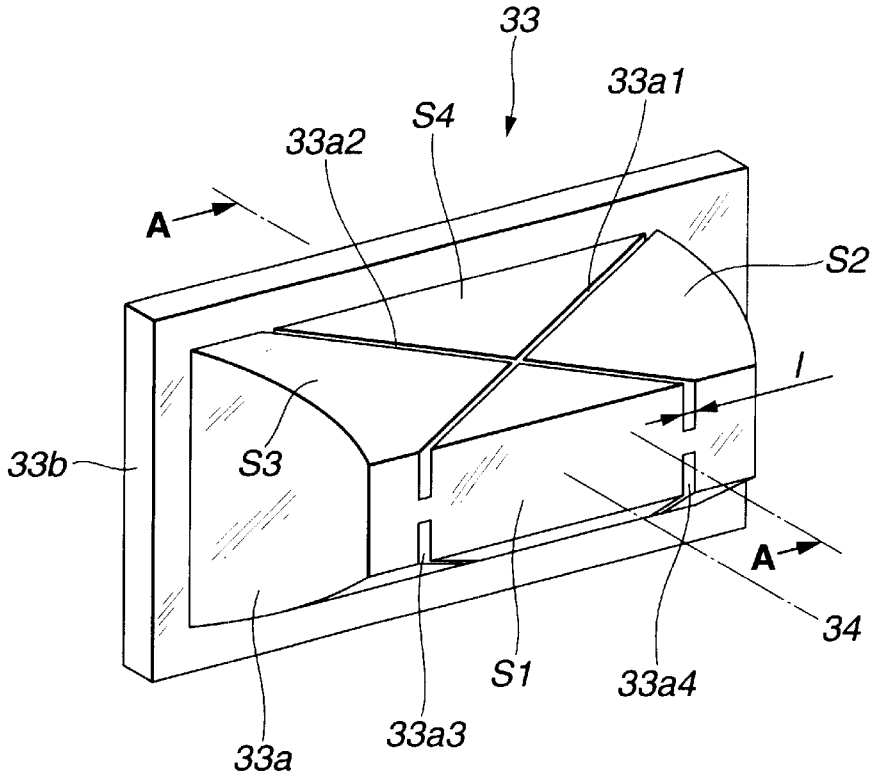
FIG. 15 is a perspective view showing the prism unit that has been integrated with the housing panel included in the illumination device shown in FIG. 14, and that has slits formed in the upper and lower surfaces thereof so that the upper slits and lower slits will be opposed to each other.
Figure 16:
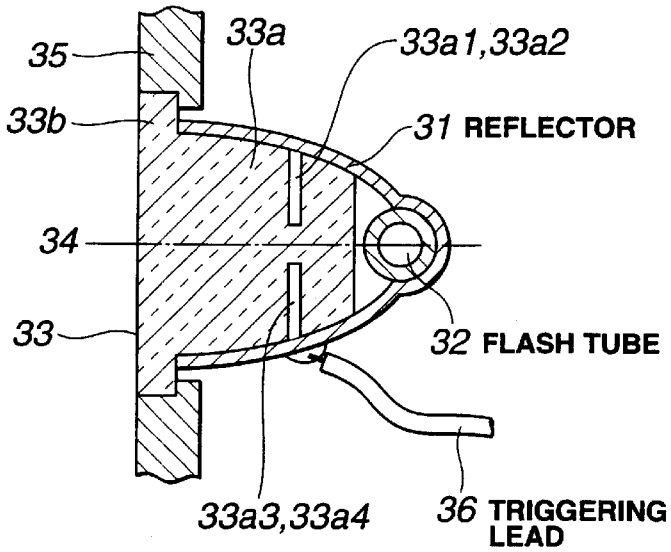
FIG. 16 is a sectional view showing the integrated prism unit that is shown in FIG. 15, encased in the reflector, and then mounted in the housing member of a camera.

FIG. 14 to FIG. 16 are sectional views showing an illumination device in accordance with a third embodiment of the present invention.

FIG. 14 shows an integrated prism unit 33 being encased in a reflector 31.

An illumination device 30 of the third embodiment shown in FIG. 14 consists mainly of the integrated prism unit 33, a flash tube 32, and the reflector 31. The integrated prism unit 33 has a housing panel 33*b* formed integratelly like a brim with the radiating side of a prism 33*a*. The flash tube 32 serves as a light source. The reflector 31 that is a reflecting member can be engaged with the outer surface of the prism 33*a* included in the integrated prism unit 33. The flash tube 32 is held in the back 31*a* of the reflector. The prism 33*a* that is an optical prism has the capability of the prism unit described in relation to the first and second embodiments.

FIG. 15 shows an example of the structure of the integrated prism unit 33. Referring to FIG. 15, slits 33*a*1, 33*a*2, 33*a*3, and 33*a*4 that constitute air layers are formed in the upper and lower surfaces of the integrated prism unit 33 as integral parts of the integrated prism unit. The slits have a substantially uniform width 1. The slits 33*a*1 and 33*a*2 forming a first air layer cross each other, and the slits 33*a*3 and 33*a*4 forming a second air layer cross each other and face the slits 33*a*1 and 33*a*2 that form the first air layer. The first and second air layers (slits) formed in the upper and lower surfaces are formed to face each other with a slitless portion, which is a vertically central portion, between them. The pair of the slits 33*a*1 and 33*a*3 or the pair of the slits 33*a*2 and 33*a*4 defines a first transmitting/totally-reflecting surface or a second transmitting/totally-reflecting surface. The slits 33*a*1 and 33*a*2 forming the first air layer are symmetrical to each other in the longitudinal direction of the flash tube 32 with respect to the center axis of radiation 34 in the illumination device 30. The slits cross each other near the center axis of radiation 34. The slits 33*a*2 and 33*a*4 forming the second air layer are symmetrical to each other in the longitudinal direction of the flash tube 32 with respect to the center axis of radiation 34 in the illumination device 30. The slits cross each other near the center axis of radiation 34. Furthermore, four portions S1, S2, S3, and S4 segmented by the crossing slits as shown in FIG. 15 are comparable to the four prisms 23*a*, 23*b*, 23*c*, and 23*d* employed in the first and second embodiment and shown in FIG. 1 and FIG. 12.

FIG. 16 is a sectional view showing the illumination device that has the integrated prism unit 33 encased in the reflector 31 as shown in FIG. 15 and is mounted in a housing member 35 of a camera body. FIG. 16 is an A—A sectional view of the integrated prism unit shown in FIG. 15. The housing panel 33*b* of the integrated prism unit 33 can be mounted in the camera housing member 35 so that the housing panel 33*b* and camera housing member 35 will be exposed on the same plane. During the mounting, the housing panel 33*b* should be merely engaged with the camera housing member 35. Thus, the prism 33*a*, reflector 31, and flash tube 32 are positioned simultaneously and accurately, and fixed to the camera housing member 35. Owing to the structure of the prism unit 33 that the prism unit 33 is integrated with the housing panel 33*b*, the man-hours and costs required to assemble the components of a camera can be reduced and the camera can be designed compactly. A triggering lead 36 soldered to the outer surface of the reflector 31 as shown in FIG. 16 is a lead over which an activating pulse that causes the flash tube 32 such as a xenon flash tube to glow is applied to a transparent electrode formed on the periphery of the flash tube 32.

The integrated prism unit 33 employed in the embodiment shown in FIG. 15 has the first and second air layers (that is, the slits) formed in the upper and lower surfaces of the prism unit. The first and second air layers are opposed to each other with a vertically central slitless portion between them. This slitless portion is equivalent to a portion devoid of the first and second transmitting/totally-reflecting surfaces. Therefore, the formation of the slitless portion may be thought to sacrifice efficiency in convergence. The reason why the convergence efficiency is not impaired with the formation of the central slitless portion will be described with reference to FIG. 17A and FIG. 17B.

Figure 17A:
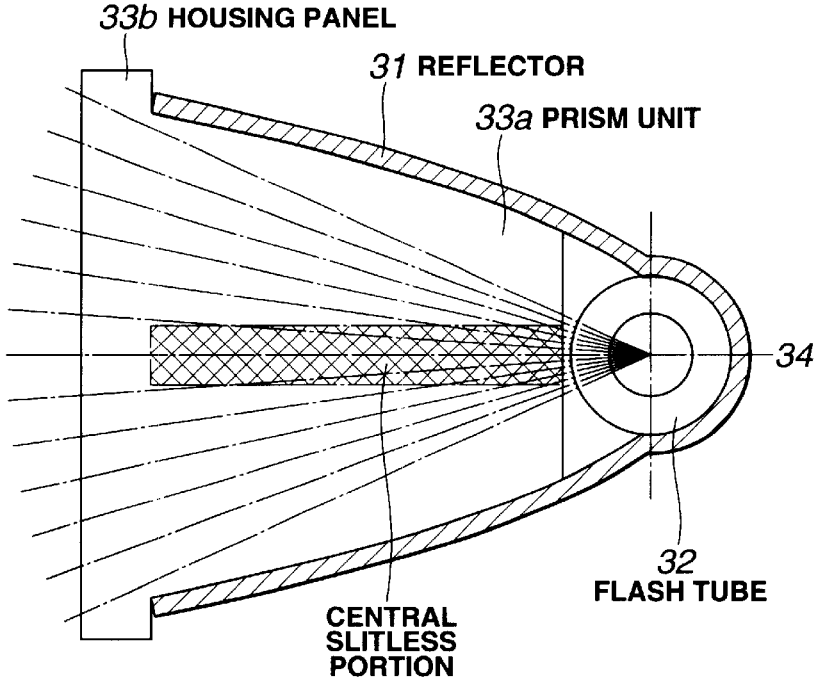
FIG. 17A and FIG. 17B are explanatory diagrams indicating that convergence of reflected light is hardly affected by the structure having a slitless central portion, such as, the integrated structure shown in FIG. 15.
Figure 17B:
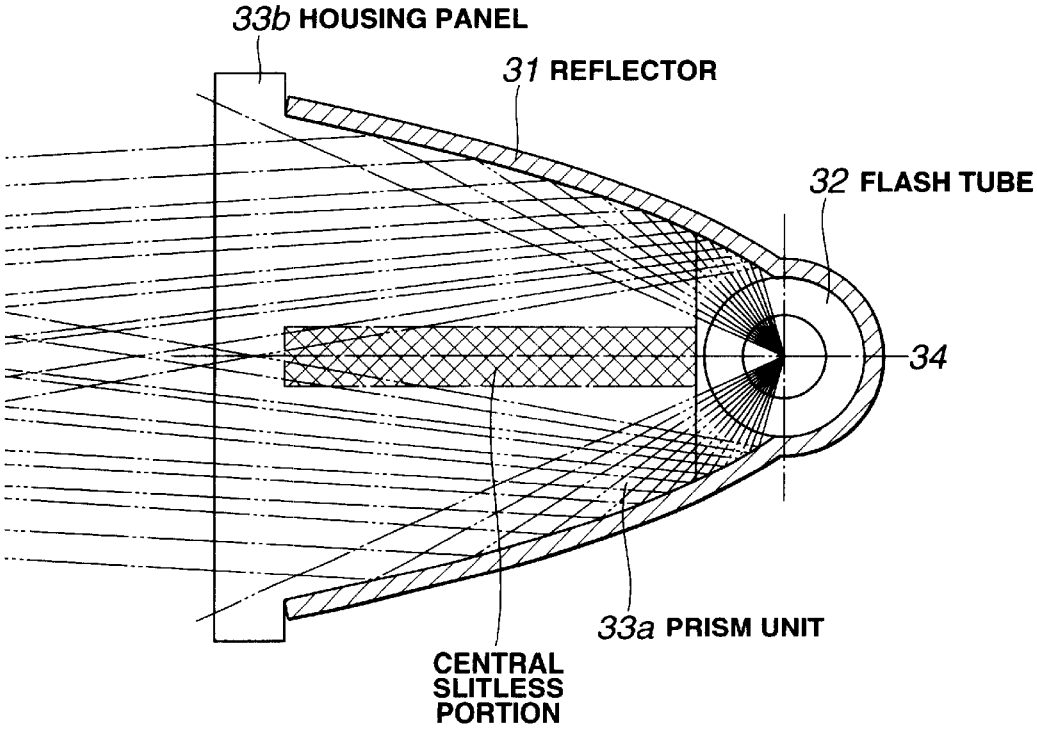

In FIG. 17A, the paths of light rays emanating forwards directly from the flash tube 32 are indicated with alternate long and short dash lines. FIG. 17B show the traces of light rays that emanate from the flash tube 32 after once reflecting from the reflector 31. Herein, a telephoto reflector is employed.

As shown in FIG. 17A, among light rays emitted forwards directly from the flash tube 32, light rays emitted to a central slitless portion (crosshatched area in the drawing) diverge without being converged by the first and second transmitting/totally-reflecting surfaces. The light rays illuminate a very narrow area. Moreover, reflected light emitted from the flash tube 32, once reflected from the reflector 31, and radiated forwards includes only a very small number of light rays that reach a central slitless portion (crosshatched area in the drawing) shown in FIG. 17B. Despite the formation of the central slitless portion, a majority of the reflected light passes through the slits (not shown), which realize the first and second transmitting/totally-reflecting surfaces, to improve convergence efficiency. Thus, apparently, the efficiency in converging reflected light is only slightly affected.

Figure 18:
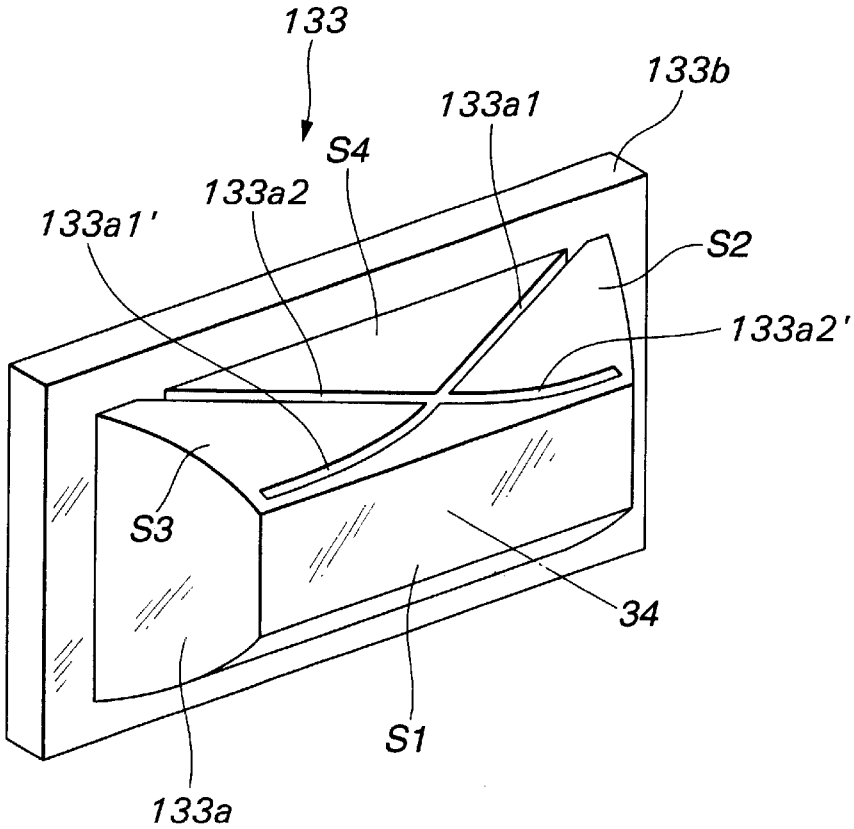
FIG. 18 is a perspective view showing a variant of the integrated prism unit shown in FIG. 15, wherein the integrated prism unit has curved slits formed in the upper and lower surfaces thereof so that the upper slits and lower slits will be opposed to each other.

FIG. 18 shows a variant of the integrated prism unit 33 shown in FIG. 15. The integrated prism unit 133 has curved slits. The integrated prism unit 33 shown in FIG. 15 has the linear slits 33*a*1 and 33*a*2 formed to cross each other. Moreover, the linear slits 33*a*3 and 33*a*4 are opposed to the linear slits 33*a*1 and 33*a*2 with the central slitless portion between them. In the structure shown in FIG. 18, linear slits 133*a*1 and 133*a*2 and curved slits 133*a*1' and 133*a*2' continuous to the slits 133*a*1 and 133*a*2 are formed so that the pair of slits 133*a*1 and 133*a*1' will cross the pair of slits 133*a*2 and 133*a*2'. Moreover, linear slits 133*a*3 and 133*a*4 (not shown) and curved slits 133*a*3' and 133*a*4' (not shown) continuous to the linear slits 133*a*3 and 133*a*4 are formed so that the pair of slits 133*a*3 and 133*a*3' will cross the pair of slits 133*a*4 and 133*a*4'. The pairs of slits 133*a*3 and 133*a*3' and 133*a*4 and 133*a*4' are opposed to the pairs of slits 133*a*1 and 133*a*1' and 133*a*2 and 133*a*2' with a central slitless portion between them. Since the curved slits are thus formed, the depth of the integrated prism unit 133 is reduced. This is helpful in designing a camera thinly and compactly.

Figure 19A:
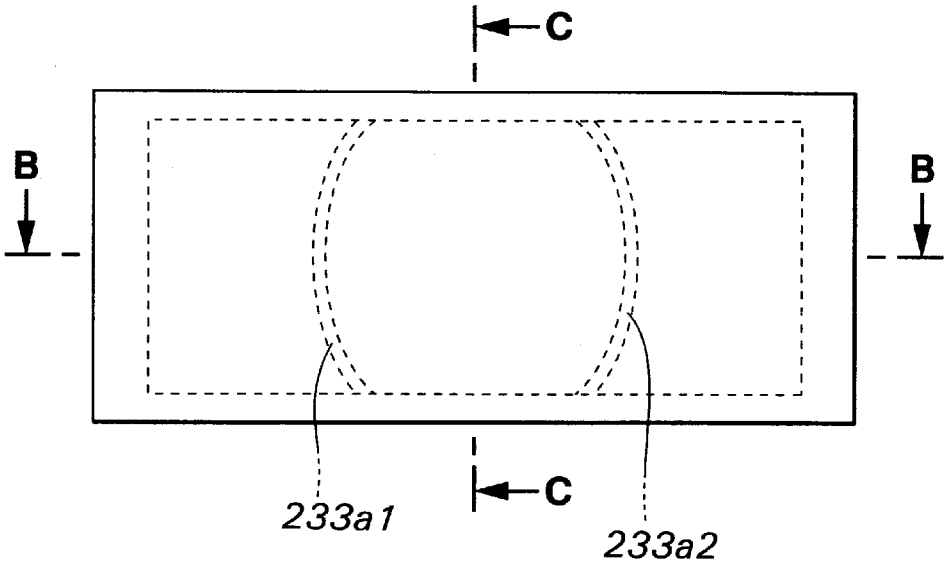
FIG. 19A is a front view of an illumination device in accordance with a fourth embodiment of the present invention, wherein the transmitting/totally-reflecting surface of an integrated prism unit is a curved surface.
Figure 19B:
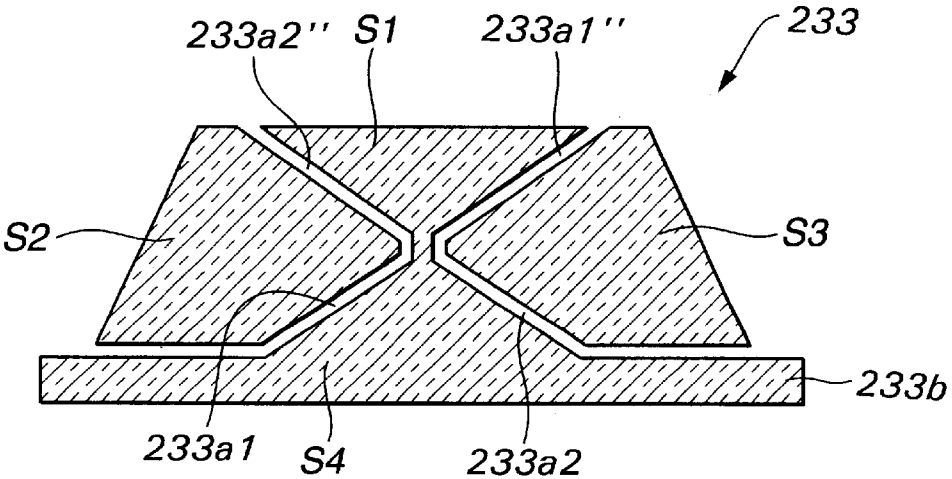
FIG. 19B is a B—B sectional view of the illumination device shown in FIG. 19A.
Figure 20:
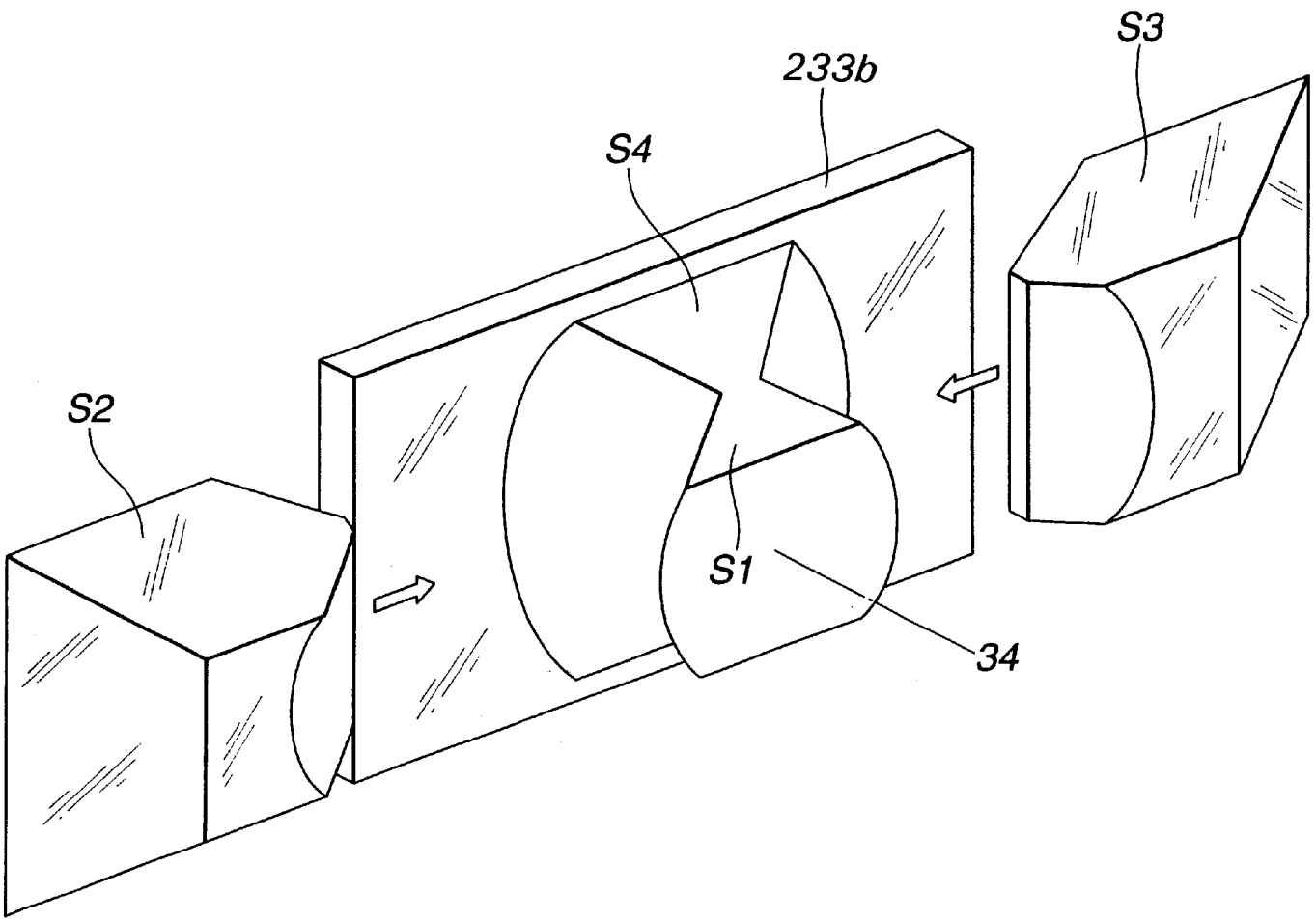
FIG. 20 is a perspective view showing the integrated prism unit shown in FIG. 19A and FIG. 19B with the members of the prism unit disassembled.

FIG. 19A and FIG. 19B show the structure of an integrated prism unit employed in an illumination device in accordance with a fourth embodiment of the present invention. FIG. 19A is a front view of the prism unit seen from a housing panel 233*b*, while FIG. 19B is a B—B sectional view of the prism unit shown in FIG. 19A. FIG. 20 is an exploded perspective view of the integrated prism unit 233 shown in FIG. 19A and FIG. 19B.

In the embodiment shown in FIG. 19A, FIG. 19B, and FIG. 20, slits (air layers) 233*a*1, 233*a*2, 233*a*1", and 233*a*2" form curved surfaces that serve as the transmitting/totally-reflecting surfaces of the integrated prism unit 233. For constituting this structure, prisms S1 and S4 included in the prism unit 233 and the housing panel 233*b* are integrated with each other. Prisms S2 and S3 included in the prism unit 233 are independent of each other (see FIG. 20)

Figure 21:
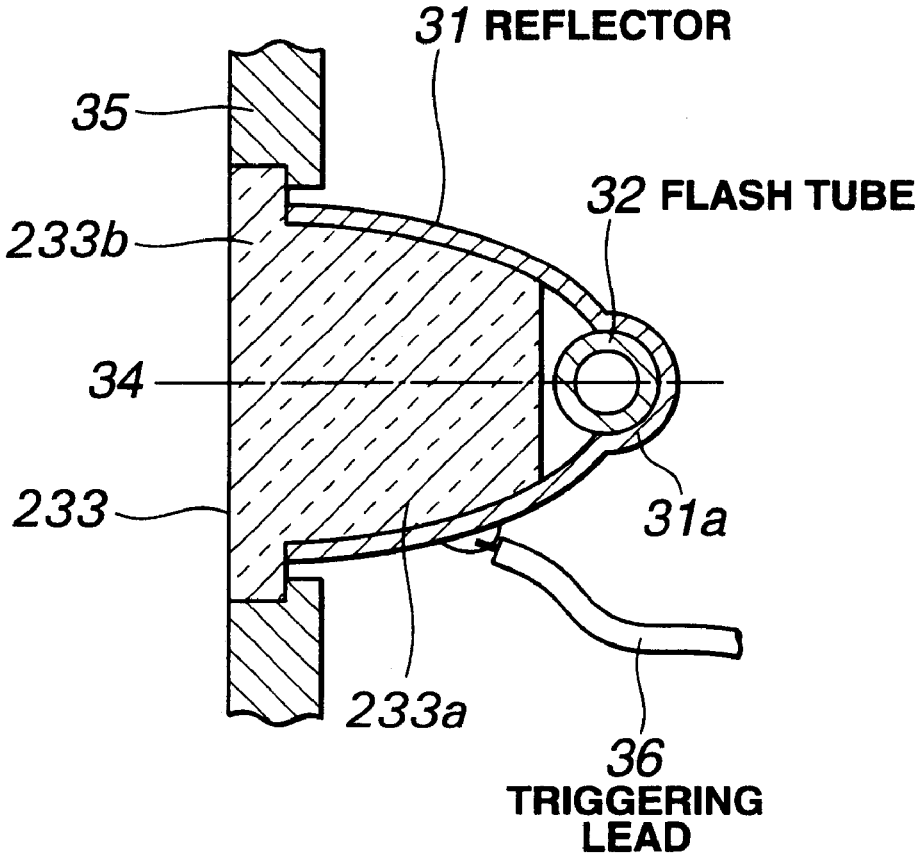
FIG. 21 is a sectional view showing the integrated prism unit that is shown in FIG. 19A and FIG. 19B, encased in a reflector, and mounted in the housing member of a camera.

FIG. 21 is a sectional view showing the integrated prism unit 233 that is shown in FIG. 19A and FIG. 19B and that is encased in the reflector 31 and then mounted in the housing member 35 of a camera body. FIG. 21 is a C—C sectional view of the prism unit shown in FIG. 19A. Even in this case, similarly to the one shown in FIG. 16, the housing panel 233*b* of the integrated prism unit 233 is mounted in the camera housing member 35 so that the outer surface of the housing panel 233*b* and that of the camera housing member 35 will be exposed on the same plane. During the mounting, the prism 233*a*, reflector 31, and flash tube 32 are positioned simultaneously and accurately and fixed to the camera body. Owing to the structure of the prism unit 233 that the prism unit 233 is integrated with the housing panel 233*b*, the man-hours and costs required in assembling the components of a camera can be reduced and the camera can be designed compactly.

Moreover, the integrated prism unit 33 described in relation to the third embodiment may be integrated by producing the prism 33*a* and housing panel 33*b* independently of each other and then boding them using a bonding means such as an adhesive. Similarly, in the fourth embodiment, the prisms S1 and S4 and the housing panel 233*b* that are produced independently of one another may be bonded using a bonding means such as an adhesive and thus integrated with one another.

As described so far, according to the present invention, an illumination device required to distribute light to a relatively narrow area enables light to efficiently converge on an object.

Furthermore, the housing panel and prism unit are integrated with each other. Eventually, a compact illumination device or camera body having a small number of components can be constituted.

Having described the preferred embodiments of the invention referring to the accompanying drawings, it should be understood that the present invention is not limited to those precise embodiments and various changes and modifications thereof could be made by one skilled in the art without departing from the spirit or scope of the invention as defined in the appended claims.

What is claimed is:

1. An illumination device comprising:

a first prism adapted to be located in front of a flash tube, and having a first transmitting/totally-reflecting surface adapted to be opposed substantially entirely to a longitudinal direction of said flash tube so that light diverging from said flash tube at an angle smaller than a predetermined angle relative to a center axis of radiation in said illumination device which lies in the longitudinal direction of said flash tube will be transmitted and radiated forwards, and so that light diverging from said flash tube at an angle larger than the predetermined angle relative to the center axis of radiation in said illumination device will be totally reflected and laterally directed;

a second prism also adapted to be located in front of said flash tube, and having a second transmitting/totally-reflecting surface adapted to be opposed substantially entirely to the longitudinal direction of said flash tube so that light diverging from said flash tube at an angle smaller than the predetermined angle relative to the center axis of radiation in said illumination device that lies in the longitudinal direction of said flash tube will be transmitted and radiated forwards, and so that light diverging from said flash tube at an angle larger than the predetermined angle relative to the center axis of radiation in said illumination device will be totally reflected and laterally directed;

a reflecting member, formed to cover at least part of a periphery of said optical prism, for reflecting light that passes the periphery of said optical prism;

a housing prism having: (i) an incidence surface on which light transmitted or totally reflected from said transmitting/totally-reflecting surface finally falls, and (ii) an emitting surface that radiates incident light on said incidence surface forwards, said emitting surface being exposed as a housing member; and a prism unit forming means for use in placing said first transmitting/totally-reflecting surface of said first prism and said second transmitting/totally-reflecting surface of said second prism on said incidence surface of said housing prism with a gap of a substantially uniform width between them.

2. An illumination device according to claim 1, wherein said first transmitting/totally-reflecting surface and second transmitting/totally-reflecting surface are substantially symmetrical to each other in the longitudinal direction of said flash tube with respect to the center axis of radiation in said illumination device, and said first and second transmitting/totally-reflecting surfaces cross each other near the center axis of radiation.

3. An illumination device according to claim 1, wherein said first transmitting/totally-reflecting surface and second transmitting/totally-reflecting surface are flat surfaces.

4. An illumination device according to claim 1 wherein said first transmitting/totally-reflecting surface and second transmitting/totally-reflecting surface each at least partly comprise a curved surface.

5. An illumination device comprising:

an optical prism adapted to be located in front of a flash tube, and having: (i) an incidence surface on which light, diverging from said flash tube falls, (ii) a transmitting/totally-reflecting surface that transmits or totally reflects light, which has passed through said incidence surface, according to an angle of incidence of the light, and that is adapted to be opposed substantially entirely to a longitudinal direction of said flash tube so that transmitted light will be radiated forwards and totally-reflected light will be directed laterally, and (iii) an emitting surface that finally radiates light, which is transmitted or totally reflected from said transmitting/totally-reflecting surface, forwards;

a reflecting member, formed to cover at least part of a periphery of said optical prism, for reflecting light, which passes the periphery of said optical prism, towards said emitting surface; and a housing panel formed integrally with said emitting surface of said optical prism and exposed as a housing member;

wherein said transmitting/totally-reflecting surface comprises a pair of air layers which have a substantially uniform width and which are adapted to face said flash tube.

6. An illumination device according to claim 5, wherein:

said pair of air layers comprises a first air layer and a second air layer that are opposed to each other with a plane, which extends forwards and contains a glowing member of said cylindrically long flash tube, between them;

each air layer comprises a first slit and a second slit that are symmetrical to each other in the longitudinal direction of said flash tube with respect to a center axis of radiation in said illumination device; and said first and second slits cross each other near the center axis of radiation.

7. An illumination device comprising:

a cylindrically long flash tube for emitting illumination light; and a prism located in front of said flash tube and having a transmitting/totally-reflecting surface that transmits or totally reflects light, which diverges from said flash tube, according to an angle of incidence of the light, said transmitting/totally reflecting surface being opposed substantially entirely to a longitudinal direction of said flash tube so that transmitted light will be radiated forward and totally-reflected light will be directed laterally;

wherein said transmitting/totally-reflecting surface comprises a first transmitting/totally-reflecting surface and a second transmitting/totally-reflecting surface that are substantially symmetrical to each other in the longitudinal direction of said flash tube with respect to a center axis of radiation in said illumination device, and wherein said first and second transmitting/totally-reflecting surfaces cross each other near the center axis of radiation.

8. An illumination device comprising:

a prism unit adapted to be located in front of a cylindrically long flash tube, and having: (i) an incidence surface on which light diverging from said flash tube falls, (ii) a transmitting/totally-reflecting surface that transmits or totally reflects light, which has passed through said incidence surface, according to an angle of incidence of the light, and that is adapted to be opposed substantially entirely to a longitudinal direction of said flash tube so that transmitted light will be radiated forwards and totally-reflected light will be directed laterally, and (iii) an emitting surface that finally radiates light, which is transmitted or totally reflected from said transmitting/totally-reflecting surface, forwards; and a reflecting member for reflecting light, which is totally reflected laterally by said transmitting/totally-reflecting surface, forwards toward said emitting surface;

wherein said incidence surface and said emitting surface of said prism unit are substantially parallel to the longitudinal direction of said flash tube; and wherein said transmitting/totally-reflecting surface of said prism unit comprises a first transmitting/totally-reflecting surface and a second transmitting/totally-reflecting surface that are substantially symmetrical to each other in the longitudinal direction of said flash tube with respect to a center axis of radiation in said illumination device, and wherein said first transmitting/totally-reflecting surface and second transmitting/totally-reflecting surface cross each other near the center axis of radiation.

9. An illumination device comprising:

a prism unit adapted to be located in front of a cylindrically long flash tube, and having: (i) an incidence surface on which light diverging from said flash tube falls, (ii) a transmitting/totally-reflecting surface that transmits or totally reflects light, which has passed through said incidence surface, according to an angle of incidence of the light, and that is adapted to be opposed substantially entirely to a longitudinal direction of said flash tube so that transmitted light will be radiated forwards and totally-reflected light will be directed laterally, and (iii) an emitting surface that finally radiates light, which is transmitted or totally reflected from said transmitting/totally-reflecting surface, forwards; and a reflecting member for reflecting light, which is totally reflected laterally by said transmitting/totally-reflecting surface, forwards toward said emitting surface;

wherein said incidence surface and said emitting surface of said prism unit are substantially parallel to the longitudinal direction of said flash tube;

wherein said transmitting/totally-reflecting surface of said prism unit comprises a first transmitting/totally-reflecting surface and a second transmitting/totally-reflecting surface that are substantially symmetrical to each other in the longitudinal direction of said flash tube with respect to a center axis of radiation in said illumination device, and wherein said first transmitting/totally-reflecting surface and second transmitting/totally-reflecting surface cross each other near the center axis of radiation; and wherein:

said first transmitting/totally-reflecting surface comprises a first air layer having a substantially uniform width, and said second transmitting/totally-reflecting surface comprises a second air layer having a substantially uniform width, said second air layer is formed to be symmetrical to said first air layer in the longitudinal direction of said flash tube with respect to the center axis of radiation in said illumination device, and said first air layer and said second air layer cross each other near the center axis of radiation.

10. An illumination device comprising:

a cylindrically long flash tube for emitting illumination light; and a prism located in front of said flash tube, and having a transmitting/totally-reflecting surface that transmits or totally reflects light diverging from said flash tube according to an angle of incidence of the light, said transmitting/totally-reflecting surface being opposed substantially entirely to a longitudinal direction of said flash tube while being inclined by a predetermined slope with respect to the longitudinal direction of said flash tube, so that transmitted light will be radiated forwards and totally-reflected light will be directed laterally;

wherein the predetermined slope by which said transmitting/totally-reflecting surface is inclined ranges from 15° to 40° relative to the longitudinal direction of said flash tube.

11. An illumination device comprising:

a cylindrically long flash tube for emitting illumination light; and a prism located in front of said flash tube, and having a transmitting/totally-reflecting surface that transmits or totally reflects light diverging from said flash tube according to an angle of incidence of the light, said transmitting/totally-reflecting surface being opposed substantially entirely to a longitudinal direction of said flash tube while being inclined by a predetermined slope with respect to the longitudinal direction of said flash tube, so that transmitted light will be radiated forwards and totally-reflected light will be directed laterally;

wherein:

said transmitting/totally-reflecting surface comprises a first transmitting/totally-reflecting surface and a second transmitting/totally-reflecting surface that are symmetrical to each other in the longitudinal direction of said flash tube with respect to a center axis of radiation in said illumination device;

said first transmitting/totally-reflecting surface and second transmitting/totally-reflecting surface cross each other near the center axis of radiation; and the predetermined slope by which said first and second transmitting/totally-reflecting surfaces are inclined ranges from 15° to 40° relative to the longitudinal direction of said flash tube.

12. An illumination device comprising:

an optical prism having a transmitting/totally-reflecting surface that transmits or totally reflects light, which diverges from a flash tube, according to an angle of incidence of the light, said transmitting/totally-reflecting surface being adapted to be opposed substantially entirely to said flash tube in front of said flash tube, and being adapted to converge and radiate light forwards;

wherein said transmitting/totally-reflecting surface comprises a pair of air layers which have a substantially uniform width and which are adapted to face said flash tube.

13. An illumination device comprising:

an optical prism adapted to be located in front of a flash tube, and having: (i) an incidence surface on which light diverging from said flash tube falls, (ii) a transmitting/totally-reflecting surface that transmits or totally reflects light, which has passed through said incidence surface, according to an angle of incidence of the light, and that is adapted to be opposed substantially entirely to a longitudinal direction of said flash tube so that transmitted light will be radiated forwards and totally-reflected light will be directed laterally, and (iii) an emitting surface that finally radiates light, which is transmitted or totally reflected from said transmitting/totally-reflecting surface, forwards;

a housing panel formed integrally with said emitting surface of said optical prism and exposed as a housing member; and a reflecting member, formed to cover at least part of a periphery of said optical prism, for reflecting light, which passes the periphery of said optical prism, towards said emitting surface.

* * * * *